US006676514B1

(12) United States Patent
Kusuda et al.

(10) Patent No.: US 6,676,514 B1
(45) Date of Patent: Jan. 13, 2004

(54) GAME SYSTEM

(75) Inventors: Kazuhiro Kusuda, Hiratsuka (JP); Takuya Ando, Kawasaki (JP)

(73) Assignee: Konami Co., Ltd., Tokyo-to (JP)

( * ) Notice: Subject to any disclaimer, the term of this patent is extended or adjusted under 35 U.S.C. 154(b) by 0 days.

(21) Appl. No.: 09/538,307

(22) Filed: Mar. 30, 2000

(30) Foreign Application Priority Data

Apr. 2, 1999 (JP) ..... P11-095740

(51) Int. Cl.[7] ..... A63F 9/24
(52) U.S. Cl. ..... 463/24; 463/29
(58) Field of Search ..... 463/29, 24

(56) References Cited

U.S. PATENT DOCUMENTS

| | | | | | |
|---|---|---|---|---|---|
| 4,462,076 | A | * | 7/1984 | Smith, III | 463/29 |
| 4,752,068 | A | * | 6/1988 | Endo | 463/15 |
| 4,858,930 | A | * | 8/1989 | Sato | 273/148 B |
| 4,874,177 | A | * | 10/1989 | Girardin | 273/246 |
| 5,014,982 | A | * | 5/1991 | Okada et al. | 463/29 |
| 5,411,258 | A | * | 5/1995 | Wilson et al. | 463/28 |
| 5,647,795 | A | * | 7/1997 | Stanton | 463/25 |
| 5,984,785 | A | * | 11/1999 | Takeda et al. | 345/156 |
| 6,009,458 | A | * | 12/1999 | Hawkins et al. | 463/1 |
| 6,256,659 | B1 | * | 7/2001 | McLain et al. | 709/100 |
| 6,324,626 | B1 | * | 11/2001 | Uenoyama et al. | 463/29 |
| 6,386,979 | B1 | * | 5/2002 | Ho et al. | 463/43 |
| 6,406,372 | B1 | * | 6/2002 | Turmell et al. | 463/1 |

FOREIGN PATENT DOCUMENTS

| | | | |
|---|---|---|---|
| JP | S63-242293 | 10/1988 | A63F/9/22 |
| JP | 08-000829 | 1/1996 | A63F/9/22 |

OTHER PUBLICATIONS

My–COM Basic Magazine (3 pages in Japanese, 1 page of abstract in English), Author: SNK.; Relevant pp.: 201 (an advertising paper); Date of publication: Jun. 1, 1990; Place of publication: Tokyo, Japan; Publisher: Denpa Shinbunsha.

* cited by examiner

*Primary Examiner*—Jessica Harrison
*Assistant Examiner*—Corbett B Coburn
(74) *Attorney, Agent, or Firm*—Jordan and Hamburg LLP

(57) ABSTRACT

A game system which is capable of ensuring continuity of a game is provided. A game system for paying for recreation value according to progress of a game, has a magnetic information reading device for reading information in an attachable/detachable recording medium, an SRAM for storing state and history of a suspended game corresponding to each of the recording media, and a medal management device for paying for recreation value according to progress of the game. Specifying information for specifying each of the recording media is recorded in each of the recording media, the state and history of the game are stored in the SRAM corresponding to the specifying information, and the rest of the game is continuously progressed by using the state and history of the game which were stored in the RAM corresponding to the specifying information read by the magnetic information reading device.

33 Claims, 18 Drawing Sheets

PLAYER'S DATA

| | |
|---|---|
| ID CODE | |
| PERSONAL INFORMATION | PLAYER'S NAME(PREFIX TO BE GIVEN TO PLAYER'S HORSE),TOTAL NUMBER OF PLAY TIMES,ETC. |
| PLAYER'S HORSE INFORMATION | NAME CODE,SEX,HORSE TYPE INFORMATION (GLOWTH TYPE), AGE,NUMBER OF START TIMES,SPEED,STAMINA,CONDITION,EARNINGS, PAST FORM(FIRST, SECOND, FOURTH AND THEREAFTER), TRAINING TYPE |
| FINAL PLAY DATE | |
| REWRITING INFORMATION | |
| CHECK CODE | |

MAGNETIC CARD INFORMATION

| | |
|---|---|
| ID CODECHECK CODE | SPECYFYING INFORMATION |
| CHECK CODE | |
| OTHER INFORMATION (SCREEN LAYOUT INFORMATION,ETC) | |

FIG. 4A

PLAYER'S DATA

| | |
|---|---|
| ID CODE | |
| PERSONAL INFORMATION | PLAYER'S NAME(PREFIX TO BE GIVEN TO PLAYER'S HORSE),TOTAL NUMBER OF PLAY TIMES,ETC. |
| PLAYER'S HORSE INFORMATION | NAME CODE,SEX,HORSE TYPE INFORMATION (GLOWTH TYPE), AGE,NUMBER OF START TIMES,SPEED,STAMINA,CONDITION,EARNINGS, PAST FORM(FIRST,SECOND,FOURTH AND THEREAFTER),TRAINING TYPE |
| FINAL PLAY DATE | |
| REWRITING INFORMATION | |
| CHECK CODE | |

FIG. 4B

MAGNETIC CARD INFORMATION

| | |
|---|---|
| ID CODECHECK CODE | SPECYFYING INFORMATION |
| CHECK CODE | |
| OTHER INFORMATION (SCREEN LAYOUT INFORMATION,ETC) | |

GAME SYSTEM

BACKGROUND OF THE INVENTION

1. Field of the Invention

The present invention relates to a game system which pays for recreation value according to progress of a game.

2. Description of the Related Art

In a medal or token game machine which is installed in a game center or the like, the continuity of a suspended game cannot be obtained. For example, in the case where a player plays a game in a specified game machine and comes back to the game machine a few days later the previous game is not related to this game in progress of the game, and this game is not influenced by the result of the previous game.

In a conventional medal game machine, while a game is in progress, a player cannot leave the game machine. For this reason, it was difficult to apply such a medal game machine to a field of a game where a player enjoys a game which continues for hours and enjoys a process of a change in a parameter of an object according to player's operation, such as a horse raising game in horse racing where a player's horse is trained and its ability is changed so as to be raised, i.e., developed. Moreover, in order to improve the appeal of games in medal game machines, it is greatly desired to provide a medal game machine which can ensure continuity of a suspended game.

OBJECT AND SUMMARY OF THE INVENTION

It is an object of the present invention to provide a game system which can ensure continuity of a game.

A first embodiment of the invention provides a game system for paying for recreating value according to progress of a game and comprises reading means for reading information in an attachable/detachable recording medium; storage means for storing a state and a history of a suspended game corresponding to the information in each of the respective recording medium; game progress means for progressing a game; and paying means for paying for recreation value according to the progress of the game in the game progress means. Information for specifying each of the recording media is recorded in each of the recording media, the state and history of the game are stored in the storage means corresponding to the specifying information, and the game progress means continuously progresses the rest of the game using the state and history of the game stored in the storage means corresponding to the specifying information read by the reading means.

In the present invention, since the states and histories of the game stored in the storage means are used, the continuity of the game can be secured. Moreover, since the states and histories of the game are stored in the storage means of the arcade machine, it is not necessary to record the states and history of the game in a recording medium which is retained by the players and detachable from the arcade machine. For this reason improper use of the recording medium can be effectively prevented.

In a second embodiment of the invention, the game system described above includes writing means for writing information into the recording medium, wherein the writing means writes the specifying information into the recording medium at the time of suspension of the game.

In a third embodiment of the invention, the writing means rewrites the specifying information in the recording medium at the time of suspension of the game.

In this case, since the specifying information is rewritten every time the game is suspended, improper use of the recording medium can be prevented effectively.

In a fourth embodiment of the invention, the game system further includes specifying information collating means for collating the specifying information stored in the recording medium and in the storage means; and specifying information creating means for creating the specifying information based on the state and history of the game. In this embodiment, the writing means writes the specifying information created by the specifying information creating means into the recording medium, and the specifying information created by the specifying information creating means is stored in the storage means.

In this case, since the specifying information is created based on the state and history of the game, the specifying information is different from each other very time of the creation. Therefore, improper use of the recording medium can be efficiently prevented.

In a fifth embodiment of the invention, the game system further includes a common field for progressing the game; and a plurality of stations for accepting input operations by a player relating to the game progressed in the common field.

In a sixth embodiment of the invention, the reading means is provided to each of the stations.

In this case, it is not necessary to carry the recording medium out of the station.

In a seventh embodiment of the invention, the storage means includes a first storage device provided to each of the stations for temporarily storing the state and history of the game generated according to the input operations, and a second storage device for updating the old state and history of the game by means of the state and history of the game stored in the first storage device.

In this case, devices with suitable performance are used as the first storage device and the second storage device so that quickness of treating the state and history of the game and enlargement of the storage capacity for the state and history of the game can be compatible with each other.

In an eighth embodiment of the invention, the game progress means reads the corresponding state and history of the game from the second storage device into the first storage device based on the specifying information read by the reading means, and continuously progresses the game using the state and history of the game read into the first storage device.

In this case, devices with suitable function are used as the first storage device and the second storage device so that the quickness of treating the state and history of the game can be ensured.

In a ninth embodiment of the invention, the state and history of the game include final play information for specifying the last time the game was played, and the older states and histories of the game stored in the storage means take priority when considering which stored game in the storage means should be deleted.

In this case, free capacity in the storage means can be maximized and optimized.

In a tenth embodiment of the invention, the state and history of the game include raising results of an object to be raised by the player on the game.

In this case, continuity of the raising game can be ensured.

In an eleventh embodiment of the invention, the state and history of the game include the raising results of an object to be raised by the player on the game, and the object to be raised participates in a race on the game, and the object displays its ability in the race according to the raised results.

In a twelfth embodiment of the invention, the state and history of the game include raised results of an object to be raised by the player in the station, and the object to be raised participates in a race on the game in the common field, and the object displays its ability in the race according to the raised results.

In a thirteenth embodiment of the invention, the object to be raised is a race horse on the game, and the object is nominated for the race in the common field.

In a fourteenth embodiment of the invention, a game system for paying for recreation value according to progress of a game includes reading means for reading information in a attachable/detachable recording medium; writing means for writing a state and history of a suspended game into the recording medium; game progress means for progressing a game; and paying means for paying for recreating value according to progress of the game in the game progress means, wherein the game progress means continuously progresses the rest of the game using the state and history read by the reading means.

In this invention, since the state and history of the game stored in the recording medium are used, the continuity of the game can be ensured.

In a fifteenth embodiment of the invention, a game system for paying for recreation value according to progress of a game includes a first game machine; a second game machine; storage means for storing a state and history of a suspended game in the first game machine; and communication means for connecting the second game machine and the storage means. The first and second game machines are provided with reading means for reading information in an attachable/detachable recording medium; game progress means for progressing a game; and pay means for paying recreation value according to progress of the game in the game progress means. Information for specifying each of recording media is recorded in the recording medium, the state and history of the game are stored in the storage means corresponding to the specifying information, the game progress means of the second game machine acquires the state and history of the game which were stored in the storage means corresponding to the specifying information read by the reading means of the second game machine via the communication means, and continuously progresses the rest of the game in the second game machine using the acquired state and history of the game.

In this invention, since the states and histories of the game stored in the storage means are used, the continuity of the game can be secured. Moreover, since the states and histories of the game stored in the storage means are obtained via communication means, the rest of the game played in a first game machine can be played in a second game machine.

In a sixteenth embodiment of the invention, the game system further includes right/wrong judging means for judging right (correctness) or wrong (incorrectness) of the specifying information read by the reading means.

In this case, since a judgment is made by right/wrong judging means as to correctness or incorrectness of specifying information in the recording medium, improper use of the recording medium can be effectively prevented.

In a seventeenth embodiment of the invention, a magnetic card is used as the recording medium.

In order to ease understanding of the invention, the reference numerals of the attached drawings are given here with the numbers being put in parentheses, but the present invention is not limited to the forms in the drawings.

BRIEF DESCRIPTION OF THE DRAWINGS

FIG. 4A is a diagram showing a data structure of player's data and FIG. 4B is a diagram showing a data structure of magnetic card information.

DETAILED DESCRIPTION OF THE INVENTION

There will be described below a game system according to one embodiment of the present invention with reference to FIGS. 1–18.

Figure 1:
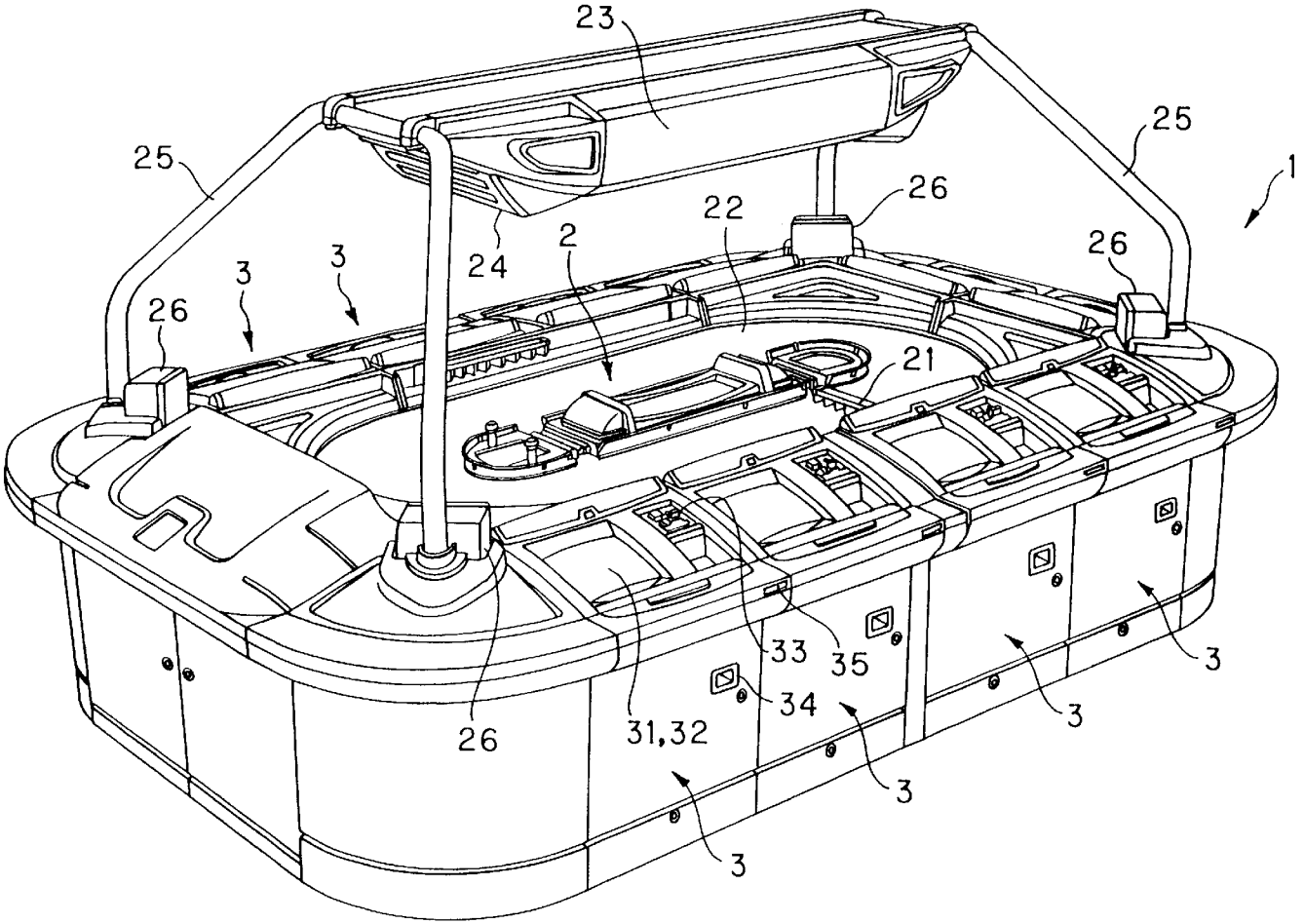
FIG. 1 is a perspective view showing an outline of a game system according to an embodiment of the present invention which is applied to a medal game machine.

FIG. 1 is a perspective view showing an outline of a game system according to the present embodiment. In the present embodiment, the game system of the present invention is applied to a so-called medal game machine which is installed in a game center (arcade) or the like.

As shown in FIG. 1, a game machine 1 has a field 2 which is provided to the center portion, and a plurality of stations 3 which are provided so as to surround the field 2.

The field 2 is provided with a racetrack 22 having a race gate 21, and models of horses (not shown) are made to run in the racetrack 22 so that races proceed like a real horse race. A plurality of speaker systems 26 for outputting a sound and the like of a running commentary on a race are provided on the circumference of the field 2.

Each of the stations 3 is provided with a display 31 for displaying a game screen according to the game progress, and a touch panel 32 which is superposed on the display surface of the display 31. When a player touches a predetermined position of the game screen displayed on the display 31 according to commands of the game screen, the position is detected by the touch panel 32 and an operated content of the player is recognized in the game machine 1. Moreover, each of the stations 3 is provided with a medal insertion portion 33 through which a medal (token) as a recreation value is inserted by the player, a medal pay opening 34 from which medals are paid to the player, and a magnetic card insertion opening 35 through which a magnetic card is inserted.

As shown in FIG. 1, a display portion 23 for displaying a name of a game and the like, and an illuminating device 24 which illuminates the field 2 are supported above the field 2 by supporting bars 25.

Next, there will be described below a summary of contents of a game using the game machine 1. In the game machine 1, races whose names are the same as those of JRA (Japan Racing Association) are successively held according to predetermined cycles. About sixty races for one year are prepared, and for each of the races, betting time, namely, time for purchasing a betting ticket, time for executing a race using the models of horses, and time for displaying race results are secured. Time for executing the races changes according to distances and the like of the respective races. The races for one year cycle once for about two hours, and when the races for one year are completed, races for the next year are started successively.

The player expects orders of arrival for each race, and can purchase betting tickets freely. The player can purchase betting tickets by betting medals, and when the purchased betting tickets coincide with the race results, a number of medals which are in accordance with a number of bet medals and odds are paid to the player. Here, the purchase of betting tickets means that the player bets medals on an expected order of arrival at the finish line (i.e., the finishing order).

In addition, the player can participate in a game as a horse owner. Namely, the player can select a desirable horse from prepared race horses, and can purchase this horse with a predetermined number of medals. Moreover, the player can select a stable of the purchased horse of his/her own will. The name of the purchased horse is created by combining a name selected from names previously stored in the game machine main body and a name inputted by the player (for example, player name). The player trains the purchased horse and raises the horse. Moreover, the player can nominate the raised horse for a desired race, and can select a jockey at the time of the nomination.

In order to ensure the continuity of the game play in the case where the player participates in the game as the horse owner, a magnetic card for storing an ID code of the player and the like is used in the game machine 1. Results of the past games of the player are stored as player's data in the game machine 1, and the ID code and the like of the magnetic card is collated with the ID code included in the stored player's data so that necessary player's data is read so as to be used for the game. For this reason, the player carries the magnetic card so as to enjoy the rest of a game at any time.

In such a manner, in the game machine 1, the races according to the schedule of the actual races in Japan proceed continuously, and the player can purchase betting tickets for desirable races as a spectator, and can purchase and raise a race horse as a horse owner and participate in the races.

Figure 2:
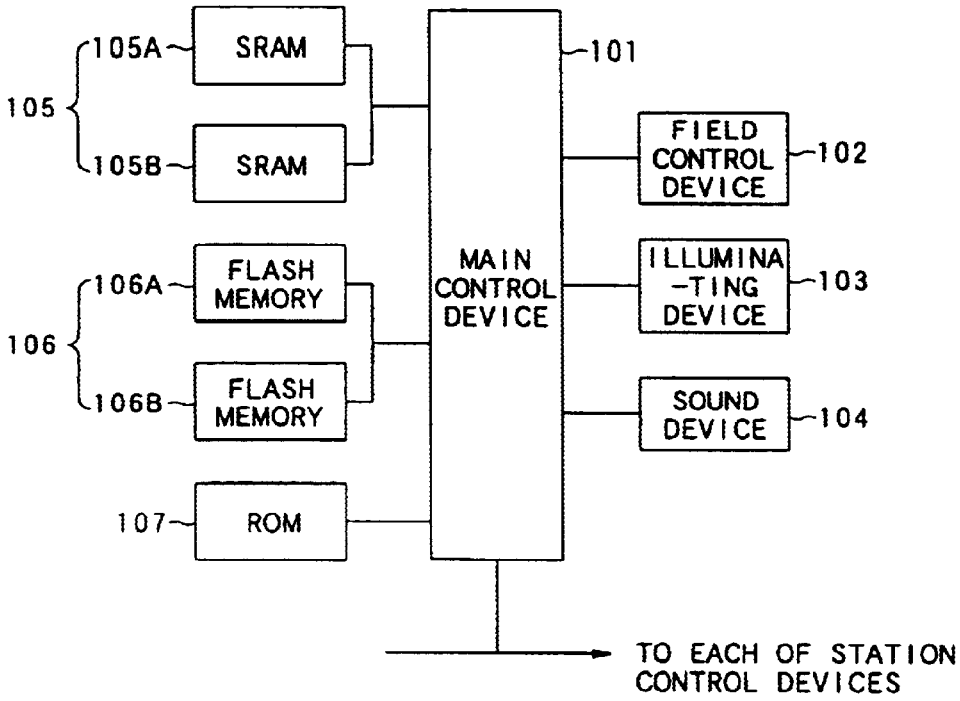
FIG. 2 is a control block diagram shoving a main control portion of a game machine of the present invention.
Figure 3:
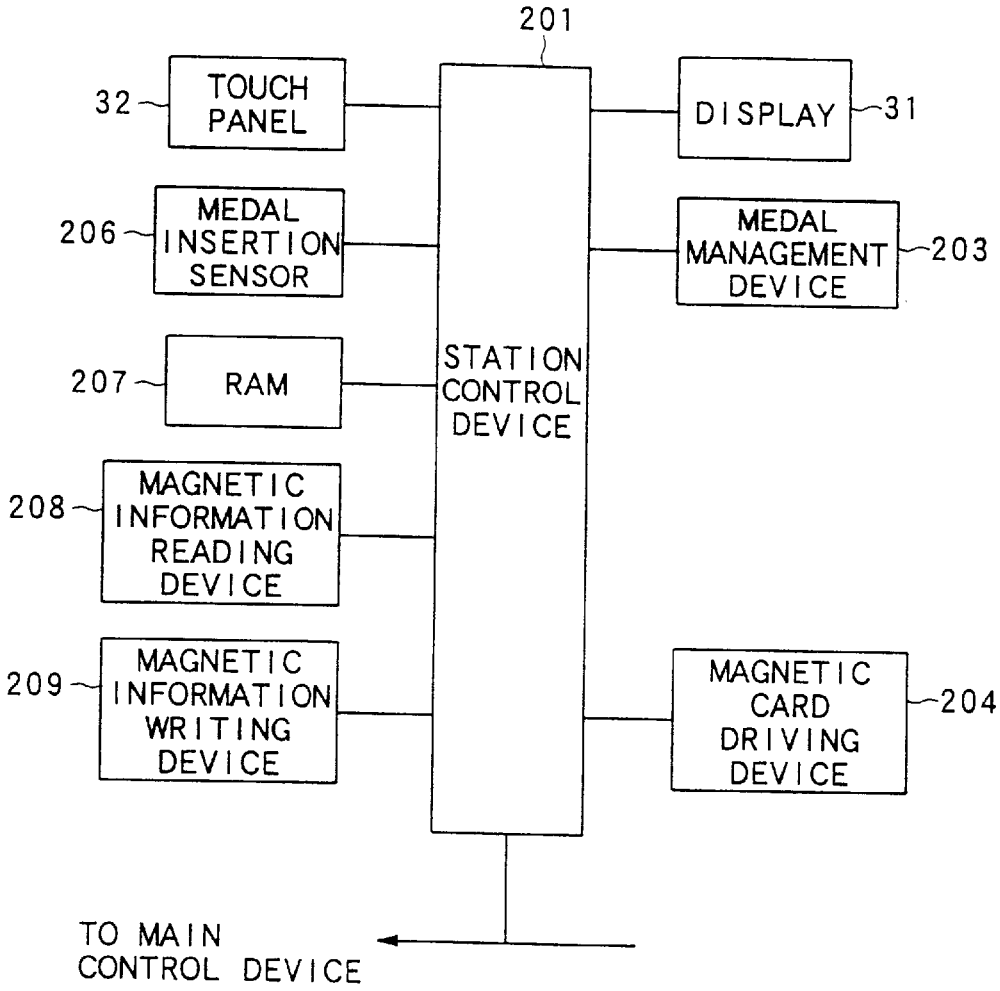
FIG. 3 is a control block diagram showing a station control portion of the game system of the present invention.

FIG. 2 is a control block diagram showing a main control portion for controlling the operation of the game machine 1 synthetically, and FIG. 3 is a control block diagram showing a station control portion provided to each of the stations 3.

As shown in FIG. 2, the main control portion which is arranged on a side of the field 2 has a main control device 101, a field control portion 102 for controlling running of the models of horses in the field 2, an illuminating device 103 for illuminating the field 2, a sound device 104 for generating sounds for reproducing an atmosphere of the racetrack, an SRAM 105 and a flash memory 106 for storing player's data, and a ROM 107 in which programs necessary for the games and various data bases are stored. The sound device 104 has the speaker systems 26 (FIG. 1). The data bases stored in the ROM 107 include 256 types of horses names selected by the player and their sound data, various data relating to the respective horses, schedule of the races and the like.

As shown in FIG. 2, the main control device 101 is connected with the field control portion 102, the illuminating device 103, the sound device 104, the SRAM 105, the flash memory 106 and the ROM 107.

The power source of the SRAM 105 is always backed up by battery or the like. Moreover, the two SRAMs 105 and the two flash memories 106 are provided, and the same data is stored in the two SRAMs 105 and flash memories 106. As a result, even when one of the data files is destroyed, the data is not lost.

As shown in FIG. 2, the SRAM 105 and the flash memory 106 have two units 105A and 105B and units 106A and 106B respectively, and when one unit malfunctions or is replaced, the other unit can be used as a backup.

As shown in FIG. 3, the station control portion which is provided to each of the stations 3 has a station control device 201, the display 31, a medal managing device 203 for managing payment of medals, a magnetic card driving device 204 for driving a magnetic card inserted into the magnetic card insertion opening 35, the touch panel 32, a medal insertion sensor 206 for detecting a medal inserted via the medal insertion portion 33, a RAM 207 for temporarily storing player's data, a magnetic information reading device 208 for reading magnetic information of the magnetic card inserted into the magnetic card insertion opening, and a magnetic information writing device 209 for writing magnetic card information into the magnetic card.

As shown in FIG. 3, the station control device 201 is connected to the display 31, the medal managing device 203, the magnetic card driving device 204, the touch panel 32, the medal insertion sensor 206, the RAM 207, the magnetic information reading device 208 and the magnetic information writing device 209.

In addition, as shown in FIGS. 2 and 3, the station control device 201 of each of the stations 3 is connected with the main control device 101, and necessary communication can be executed between the station control device 201 and the main control device 101.

FIG. 4A shows a data structure of the player's data which is stored and managed per player. The player's data include information about a state and history of a game. As shown in FIG. 4A, the player's data is composed of an ID code allocated to each player, personal information about the player, information about a player's horse relating to a player horse, last play date information for specifying the date on which the player played the game last, rewriting information for recording updating of the data, and a check code for preventing interpolation of the magnetic cards and the like.

In the present embodiment, the ID code and check code are used as specifying information.

The ID code is a number which is allocated to one player, and it is set so as not to overlap an ID of another player's data.

The personal information is information relating to a player such as a name of the player and a total number of play times. The personal information is used as data for game contents and also as customer managing data. Here, the player's name is used also as a prefix which is given to a name of a player's horse included in the information about the player's horse.

The information about the player's horse is composed of a name code for specifying a name of each horse, sex, horse type information specified as a growth curve, age, a number of entries, speed, stamina, condition, accumulated earnings, forms per past race (for example, first, second or fourth and thereafter), a training type determined according to a selected stable and the like.

The last play date represents a date on which the player played last using the player's data. More specifically, the last play date represents elapsed days from a certain past day, such as Jan. 1, 1999. The last play date and the player's data are compared so that incompatibleness can be checked. As a result, the data of the last play date can be utilized for preventing improper information from being used.

The personal information and the information about a player's horse and the last play date information are used as a game history for ensuring continuity of a suspended game.

The rewriting information is a numerical value which increases every time the player's data are updated by a training process or the like, mentioned later. In the case where the player's data is updated based on the game play in the station 3, an even number value is stored as the rewriting information. However, in the case where the player's data are updated finally in the main control device 101 due to any reasons such as an accident of the station 3 or the like, this numerical value obtains an odd number until next updating.

The player's data is retained in the SRAM 105 or the flash memory 106. Moreover, when the player plays a game in the station 3, the necessary player's data is read into the RAM 207 of the corresponding station 3 so as to be utilized for various processes in the station 3.

The check code is an error detecting code which is created based on the respective data of the ID code, personal information, information about a player's horse, last play date and rewriting information, and it is used for checking existence of interpolation and accident in the magnetic card, and as to whether or not the player's data is transmitted and received properly between the station 3 and the main control device 101.

FIG. 4B shows specifying information to be recorded in the magnetic card. The specifying information is used for specifying a player, and as shown in FIG. 4B, the specifying information is composed of the ID code and check code of the player's data. The other data composing the player's data are not recorded in the magnetic card. As a result, inaccuracies in the interpolation of the magnetic card information can be prevented. As shown in FIG. 4B, also information which is not used for creating the error detecting code, such as layout information and the like on the screen which is not related to the game progress, can be recorded in the magnetic card.

DESCRIPTION OF OPERATION

There will be described below a part of the operation of the game machine 1 with reference to FIGS. 5–18. Various input operations which are performed by the player according to the display on the display 31 are recognized in the station control device 201 based on a signal outputted from the touch panel 32, but the description of the process for recognizing the input operations will be omitted.

Figure 5:
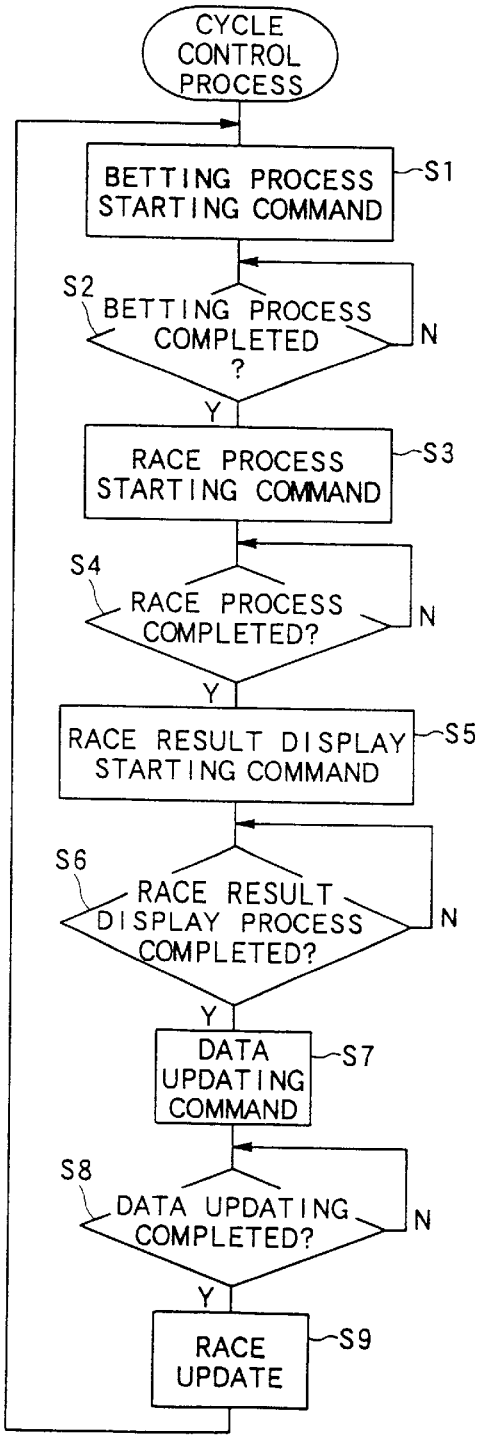
FIG. 5 is a flowchart showing a cycle control process.

FIG. 5 is a flowchart showing a cycle control process which is carried out in the main control device 101. The cycle control process is carried out in order to carry out the annual races in predetermined order and to direct switching timing of various processes included in the races.

In the cycle control process, the main control device 101 exercises control over the game machine 1 so as to execute (1) a betting process, namely, a process for purchasing betting tickets, (2) a race process for a making horses to enter and executing a race, (3) a race result display process for displaying order of arrival and odds in the race and the like, and (4) a data updating process for transmitting latest player's data from each of the stations 3, and updating the player's data in the SRAM 105.

Figure 15:
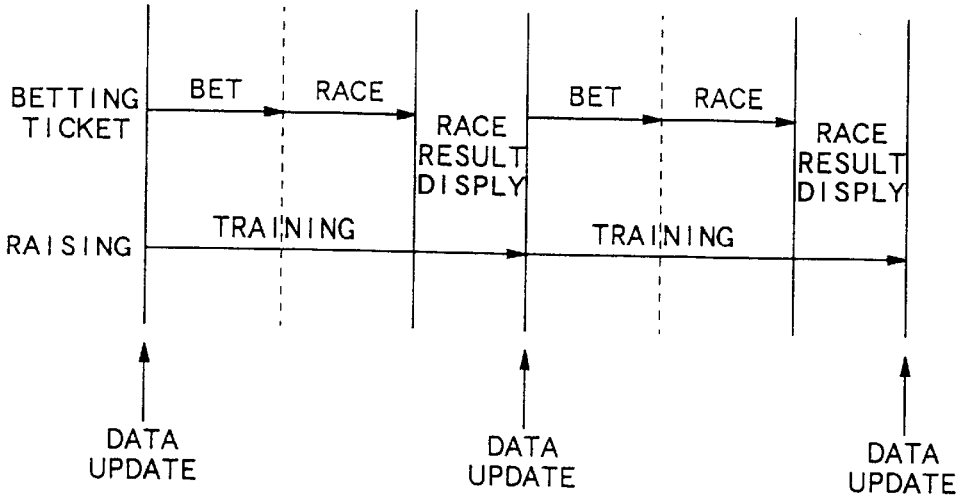
FIG. 15 is a diagram showing a cycle of a game progress.

According to the above processes, while the game machine 1 is operated, the annual races held in Japan are executed one by one in a predetermined order and with a period of about 2 minutes for 1 cycle. A raising process, mentioned later, is executed with a predetermined period within the above cycle together with the above processes (see FIG. 15). FIG. 15 shows a part of the race cycle which is controlled by the cycle control process.

Next, there will be detailed below the cycle control process. At step S1 in FIG. 5, starting of the betting process is commanded. Upon receiving this command, the betting process is executed in the station control device 201 in each of the stations 3. Next at step S2, the sequence waits until the betting process is completed and proceeds to step S3 once the betting process is completed.

At step S3, starting of the race process is commanded. Upon receiving this command, an operation for running models of horses and various processes (not shown) for realizing output of necessary sounds and the like are executed based on the control of the main control device 101. At the next step S4, the sequence waits until the race process is completed and proceeds to step S5 once the race is completed.

At step S5, starting of the race result display process is commanded. Upon receiving this command, a predetermined process (not shown) for displaying order of arrival, odds, allotment and the like on the display 3 is executed in the main control device 101. At the next step S6, the sequence waits until the race result display process is completed and proceeds to step S7 once the display process is completed.

At step S7, a data updating command for updating the player's data is transmitted, and the sequence waits until the data updating process is completed at step S8 and proceeds to step S9 once the data updating process is completed. At step S9, the race is updated to a next race and the sequence returns to step S1. At step S8, when a data updating completion flag which is set by the data updating process is ON, a judgment or determination is made that the data updating process is completed, and the data updating completion flag is turned OFF at step S9. The data updating process will be described later.

Next, there will be described below a process of the station control device 201 in the case where a magnetic card is inserted into the magnetic card insertion opening 35 of the station 3 with reference to FIG. 6.

Figure 6:
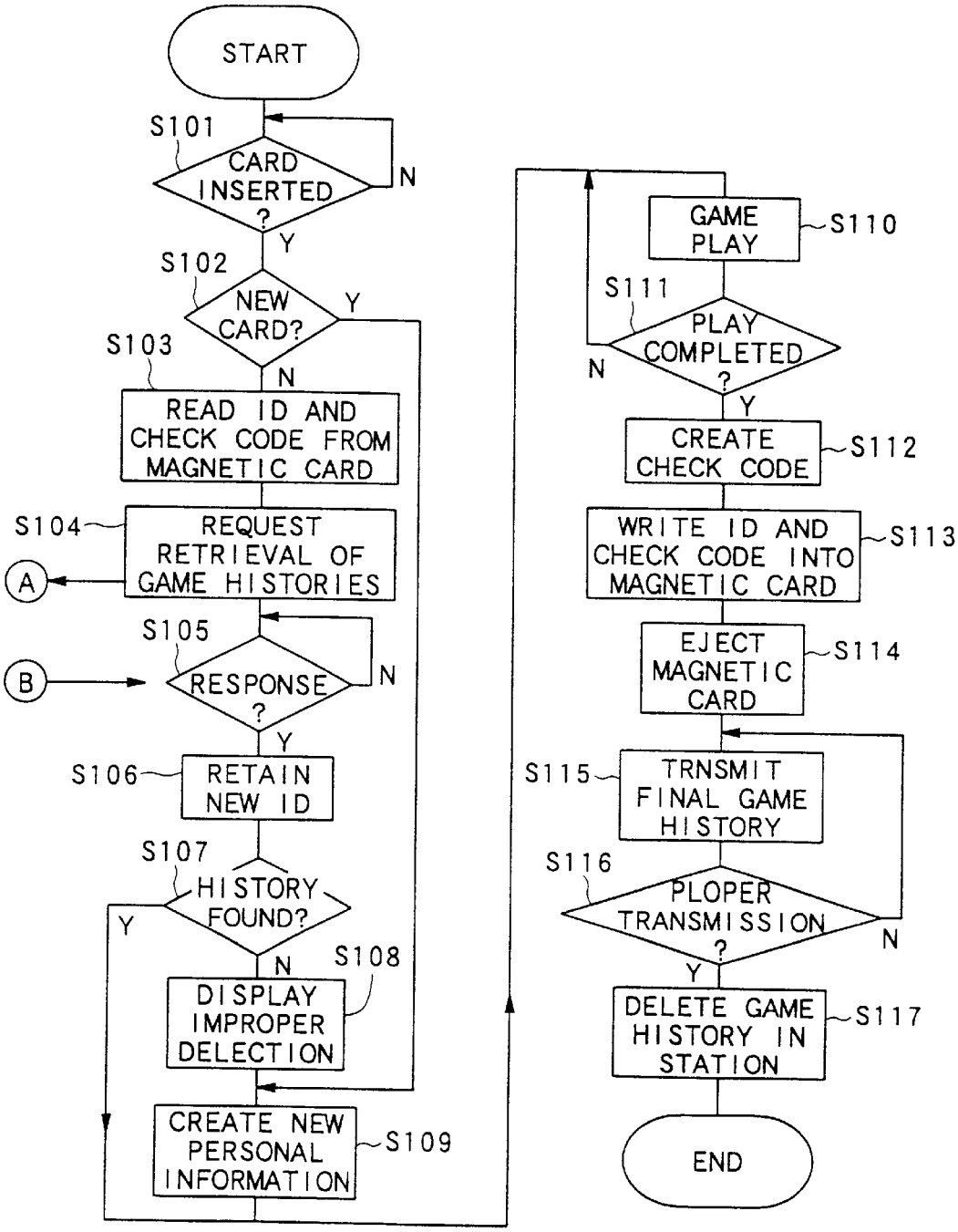
FIG. 6 is a flowchart showing a process in a station control device after a magnetic card is inserted.

At step S101 in FIG. 6, the sequence waits until the magnetic card is inserted into the card insertion opening 35 and the proceeds to step S102, and a judgment or determination is made as to whether or not the inserted magnetic card is a new card. When the determination is NO, the sequence jumps to step S109. When the determination is YES, the magnetic card driving device 204 and the magnetic information reading device 208 are controlled at step S103 so that the ID code and check code of the magnetic card are read.

At the next step S104, the ID code and check code of the inserted magnetic card are transmitted to the main control device 101, and the main control device 101 is requested to retrieve the player's data whose ID code is identical to the ID code of the magnetic card (FIG. 6 "A"). Upon receiving this request, the main control device 101 retrieves the ID code, but this process will be mentioned later.

At the next step S105, the sequence waits for response from the main control device 101 and goes to step S106 so that a new ID code transmitted from the main control device 101 is retained in the RAM 207. The response from the main control device 101 and the like (FIG. 6 "B") will be described below.

At the next step S107, when as a result of the retrieval in the main control device 101, the determination is made that the player's data whose ID matches the ID of the magnetic card exists, the sequence jumps to step S110. When the determination is made that the player's data whose ID does not match with the ID of the magnetic card does not exist, at step S108 the states that the contents of the magnetic card are improper or the past information is deleted due to the expiration are displayed on the display 31, for example, so that these states are posted to the player. At the next step S109, new personal information is prepared and the sequence goes to step S110.

At step S110, a process necessary for the game play by the player is executed. The raising process (FIG. 7), mentioned later, is included in this process. The process at step S110 is continued until a judgment or determination is made that the play is completed at step S111.

When the determination is made that the play is completed at step S111, a check code is created based on the latest player's data, and the new (current) ID code and check code are written into the magnetic card (step S113), and the magnetic card is ejected (step S114).

At step S115, a state and history (player's data) of the final game stored in the RAM 207 are transmitted to the main control device 101, and when proper transmission is checked (step S116), the player's data in the RAM 207 is deleted at step S117 and the process in FIG. 6 is completed. The state and history (player's data) of the game transmitted at step S115 are stored in the SRAM 105 and are retained therein until the next time the player plays a game.

Figure 7:
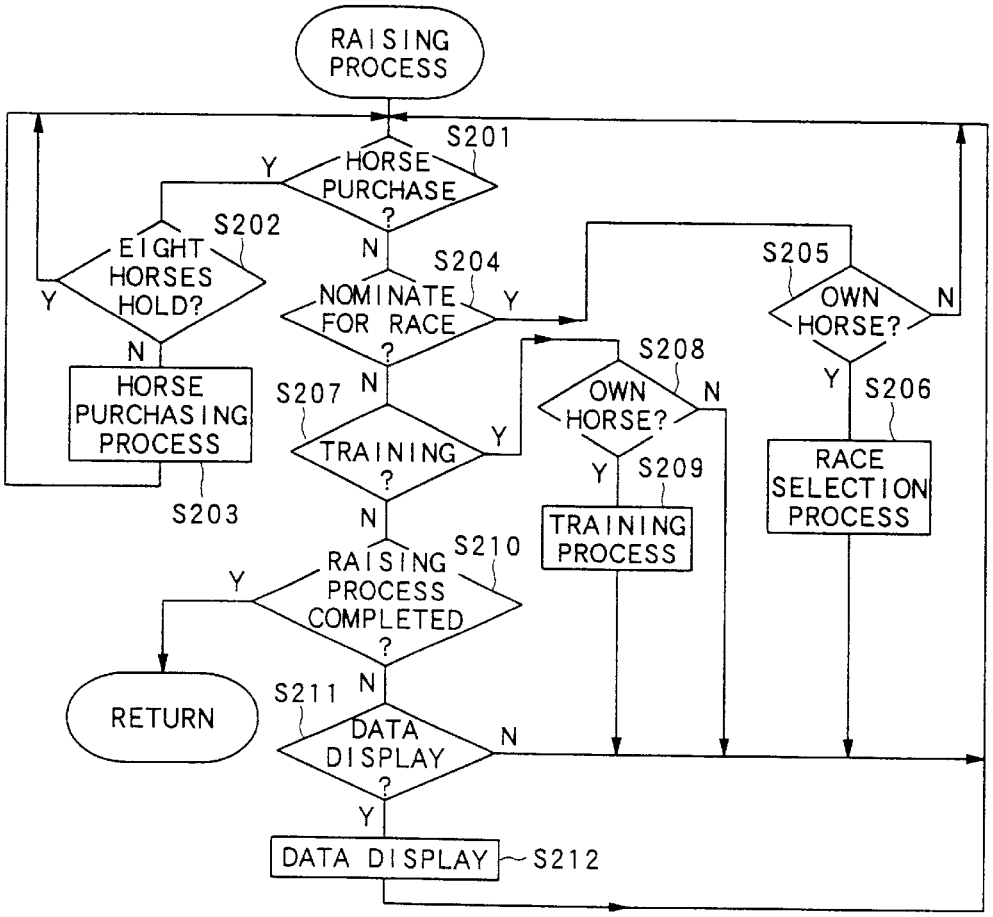
FIG. 7 is a flowchart showing a raising process.

There will be described below the raising process at step S200 with reference to FIGS. 7–15. FIG. 7 is a flowchart showing the raising process (step S200) which is executed in the station control device 201.

At step S201 in FIG. 7, a determination is made as to whether or not an operation for selecting purchase of a horse is performed by the player, and when the determination is YES, the sequence goes to step S202. At step S202, a judgment or determination is made as to whether or not the player already owns eight horses referring to the player's data stored in the RAM 207, and when the determination is YES, the sequence returns to step S201, and when the determination is NO, the sequence goes to step S203. In the case where the player already owns eight horses, the player cannot purchase more horses.

Figure 8:
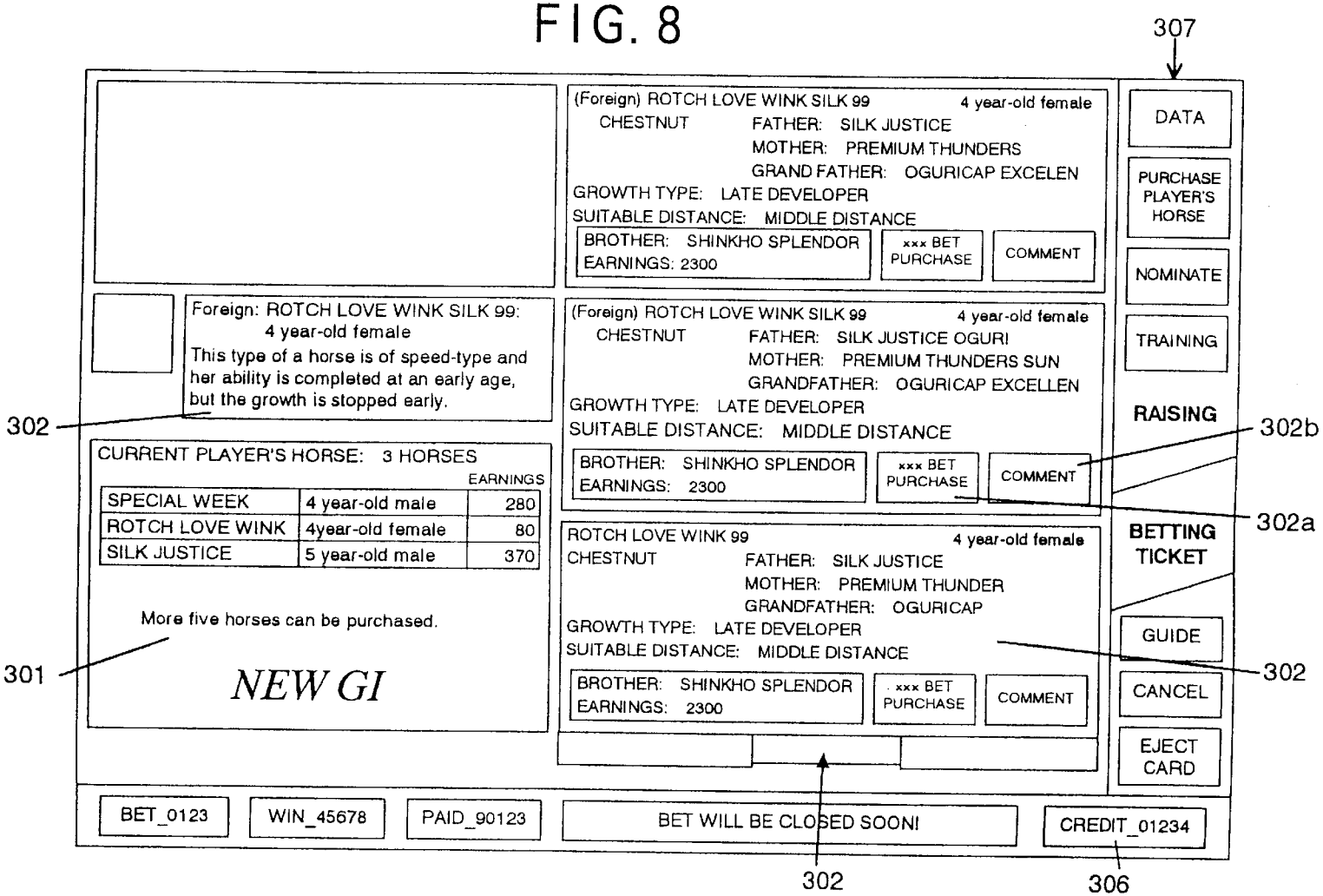
FIG. 8 is a diagram showing a player's horse selection screen.
Figure 9:
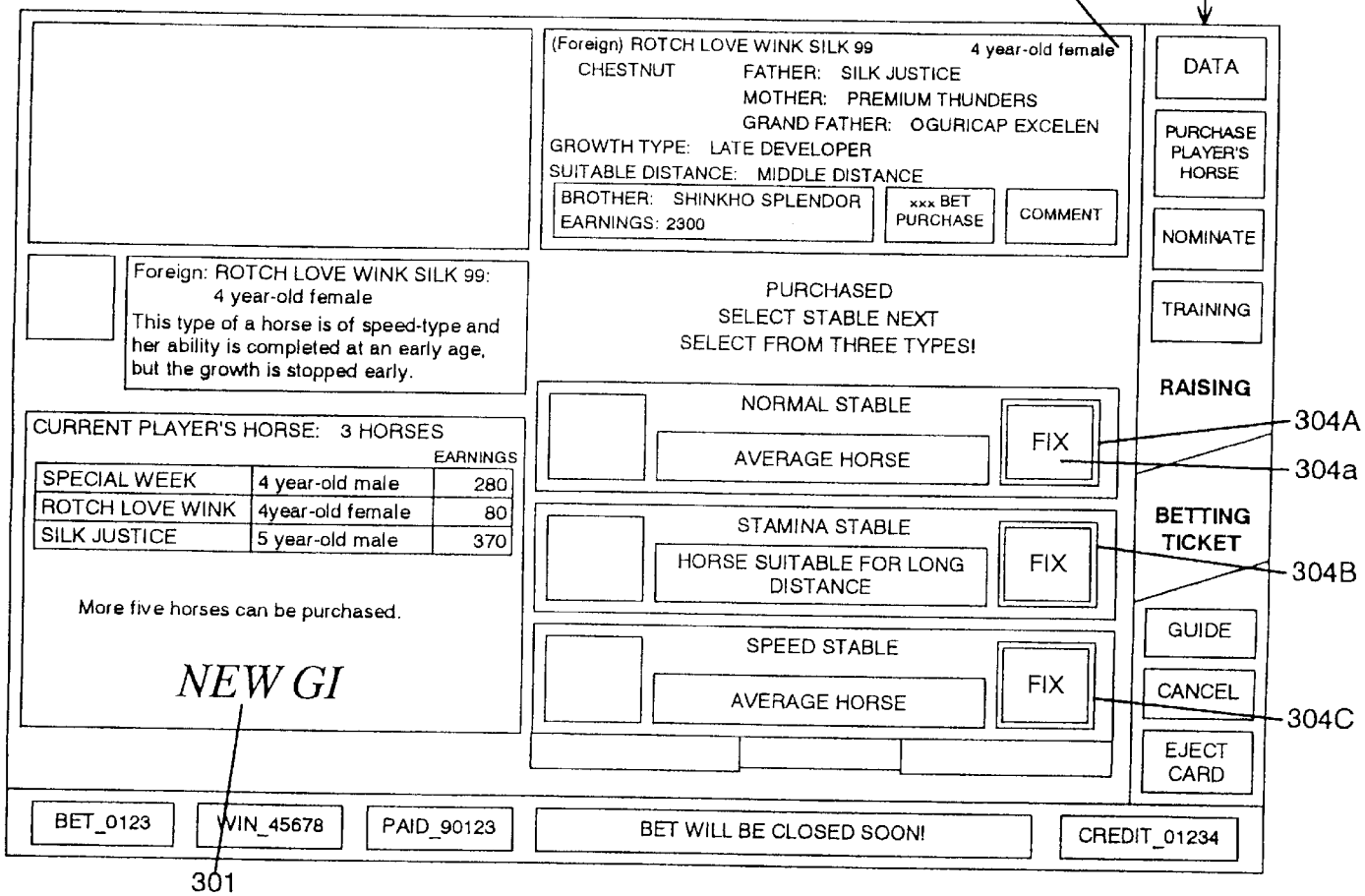
FIG. 9 is a diagram showing a stable selection screen.
Figure 10:
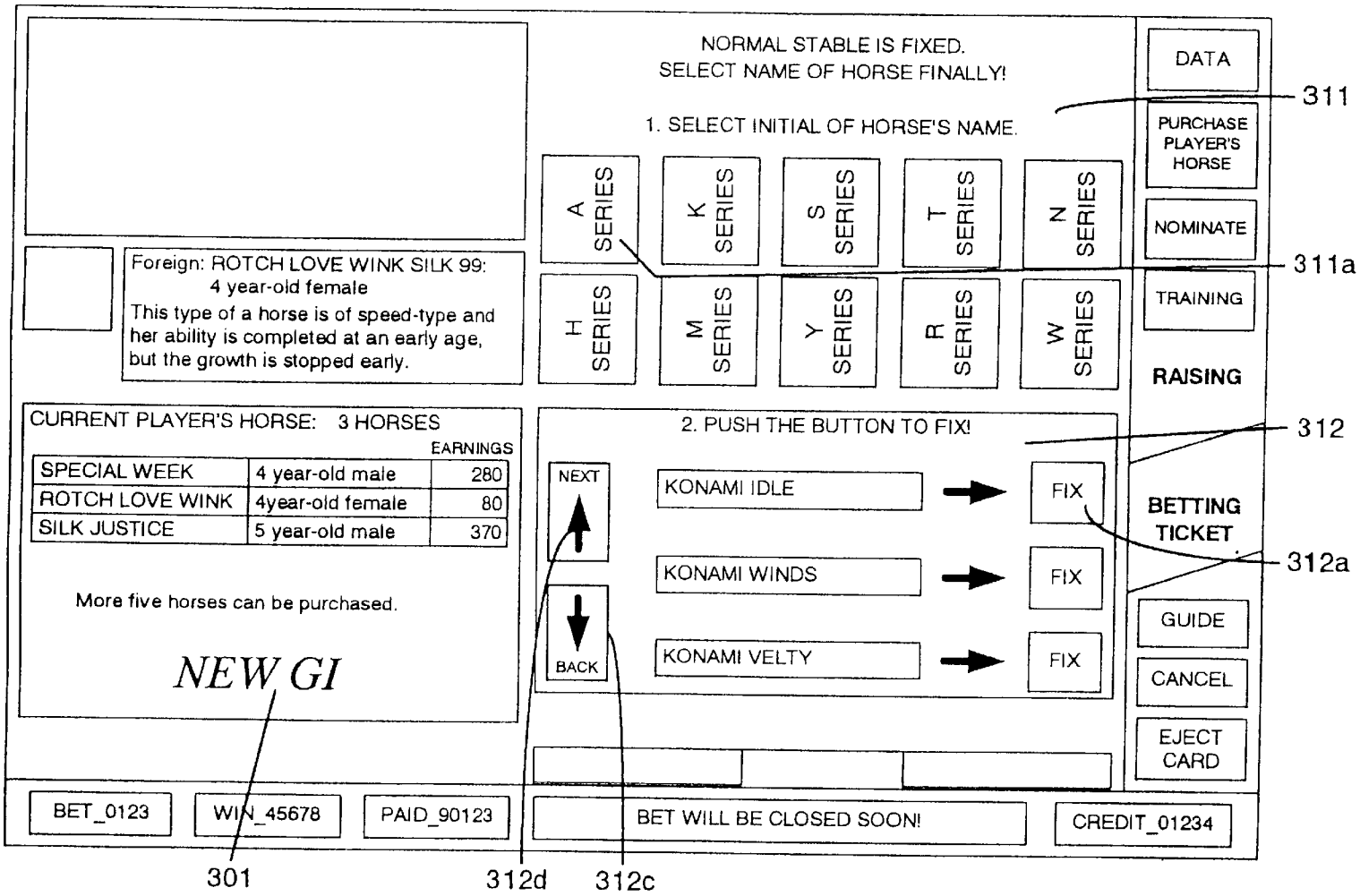
FIG. 10 is a diagram showing a horses name selection screen.

There will be described below the process at step S203 with reference to FIGS. 8–10. FIG. 8 is a diagram showing a player's horse selection screen, FIG. 9 is a diagram showing a stable selection screen, and FIG. 10 is a diagram showing a horse name selection screen.

At step S203, a process that the player can purchase horses is executed. In this process, the player's horse selecting screen shown in FIG. 8 is displayed on the display 31 with reference to the player's data in the RAM 207. The horses which are already been owned by the player are displayed on a left area 301 of the player's horse selection screen (three horses are displayed in FIG. 8). Information about the three horses which are candidates to be purchased is displayed on a right area 302. Moreover, a bet button 302*a* which shows a bet number necessary for purchasing the respective horses is displayed in an area 302 which is allocated to the respective horses as candidates. A comment on one of the horses displayed as candidates is displayed in an area 303 provided above the area 301. This comment is displayed in such a manner that a comment button 302*b* for the corresponding horse is operated by the player.

In FIG. 8, the three horses are displayed in the area 302, but a number of horses may be set to a larger value, or candidates to be displayed are replaced successively at predetermined timing or an operation by the player so that a selectable number of horses can be increased.

When the player operates the purchase button 302*a*, a horse corresponding to the purchase button 302*a* is selected and purchased as a player's horse. A number of bets (a number of medals) paid by the player at the time of the purchase of a horse is set to a value according to the ability of the horse, and in the case of a strong horse, the number of bets becomes larger.

As shown in the area 302, a growth type, a suitable distance and the like such as precocity and late developer are set for the respective horses, and the player can select the raising method which is suitable for a character of the horse, or can select a race for which the horse is nominated. As shown in the process at step S202, the player cannot own nine and more horses.

The horses displayed in the area 302 can be changed for each of the stations 3, and the horses to be displayed may be changed according to current credit. For example, in the station 3 where the credit is low, horses whose purchase prices are low may be mostly displayed, and in the station 3 where the credit is high, horses whose purchase prices are high may be mostly displayed. Moreover, only horses which can be purchased by current credit may be displayed in the area 302 of the respective stations 3. In such a manner, when the display of horses is changed according to credit, a number of horses to be displayed is decreased so that the display on the screen can be simple. Moreover, since only horses which can be purchased by the player are displayed, the operation by the player becomes simple. A number of current credits is displayed in an area 306 at the lower-right comer of the player's horse selection screen.

The purchase of the player's horses is stored by updating the player's data in the RAM 207.

As shown in FIG. 8, during the game, an area 307 is obtained on a right end portion of the screen so that game modes in the station 3 (betting ticket purchase mode, horse raising mode) can be changed. When the player operates the buttons in the area 307, a mode is changed into the mode corresponding to the operated or depressed button, and a predetermined game screen corresponding to the mode is displayed on the display 31. The data display mode, horse purchase mode, nominating mode and training mode which compose the raising mode are changed by operating the buttons in the area 307.

After the purchase of the horses, a stable selection screen shown in FIG. 9 is displayed on the display 31 with reference to the player's data in the RAM 207. A right side of the stable selection screen is provided with areas 304A, 304B and 304C for selecting three types of stables: normal stable; stamina stable and speed stable. Fix buttons 304*a* are provided respectively in the areas allocated respectively to the stables, and when the player operates the fix button 304*a*, the stable corresponding to the fix button 304*a* is selected.

Information about a horse purchased this time is displayed in an area 305 provided on a upper right side of the stable selection screen, and the player can select a stable while referring to that information.

As shown in the areas 304A, 304B and 304C, when the stamina stable is selected, the horse is raised as long distance type, when the speed stable is selected, the horse is raised as short distance type, and when the normal stable is selected, the horse is raised as average type which does not lean towards the long distance type or short distance type.

The selected stable is stored by rewriting the player's data in the RAM 207.

After the selection of the stable, the horse name selection screen shown in FIG. 10 is displayed on the display 31 with reference to the player's data in the RAM 207. As a horse name to be used for the player's horse, one horse name is selected from prepared 256 types of horse names. A right side of the horse name selection screen is provided with an area 311 for retrieving a horse name using initials. Moreover, an area 312 on which three horse names according to the initials selected by a button 311 a is provided below the area 311. As shown in FIG. 10, a name that prefix "Konami" is added to a horse name "idle" is displayed in the area 312. The prefix is nothing but the name of the player included in the personal information (see FIG. 4A). When buttons 312*c* and 312*d* provided in the area 312 are operated, horse names arranged in the order of the Japanese alphabet can be changed successively. When the player operates the fix button 312*a* provided in the area 312, the horse name displayed on the left side of the button 312*a* is selected as a formal name of the horse purchased this time.

The horse name included in the names of player's horses is outputted as a sound via the sound device 104 at the time of live call when the horse is nominated for the race so that presence of the race is improved. In such a manner, the name of the player's horse is created by combining the horse name which is selected from prepared 256 types of horse names and the prefix, and the horse name is outputted as a sound so that a special horse name which does not overlap another player's horse names can be secured and the horse name can be outputted as natural sound at the time of live call.

The name of the player's horse is stored as the player's data in the RAM 207.

After the above process is completed, the sequence returns from step S203 to step S201 (FIG. 7).

Meanwhile, when the determination at step S201 is NO, the sequence goes to step S204 so that a determination is made as to whether or not the player selects nomination for the race. When the determination is YES, the sequence goes to step S205 so that a determination is then made as to whether or not the player owns a player's horse. When the determination is YES, the sequence goes to step S206, and when the determination is NO, the sequence returns to step S201.

Figure 11:
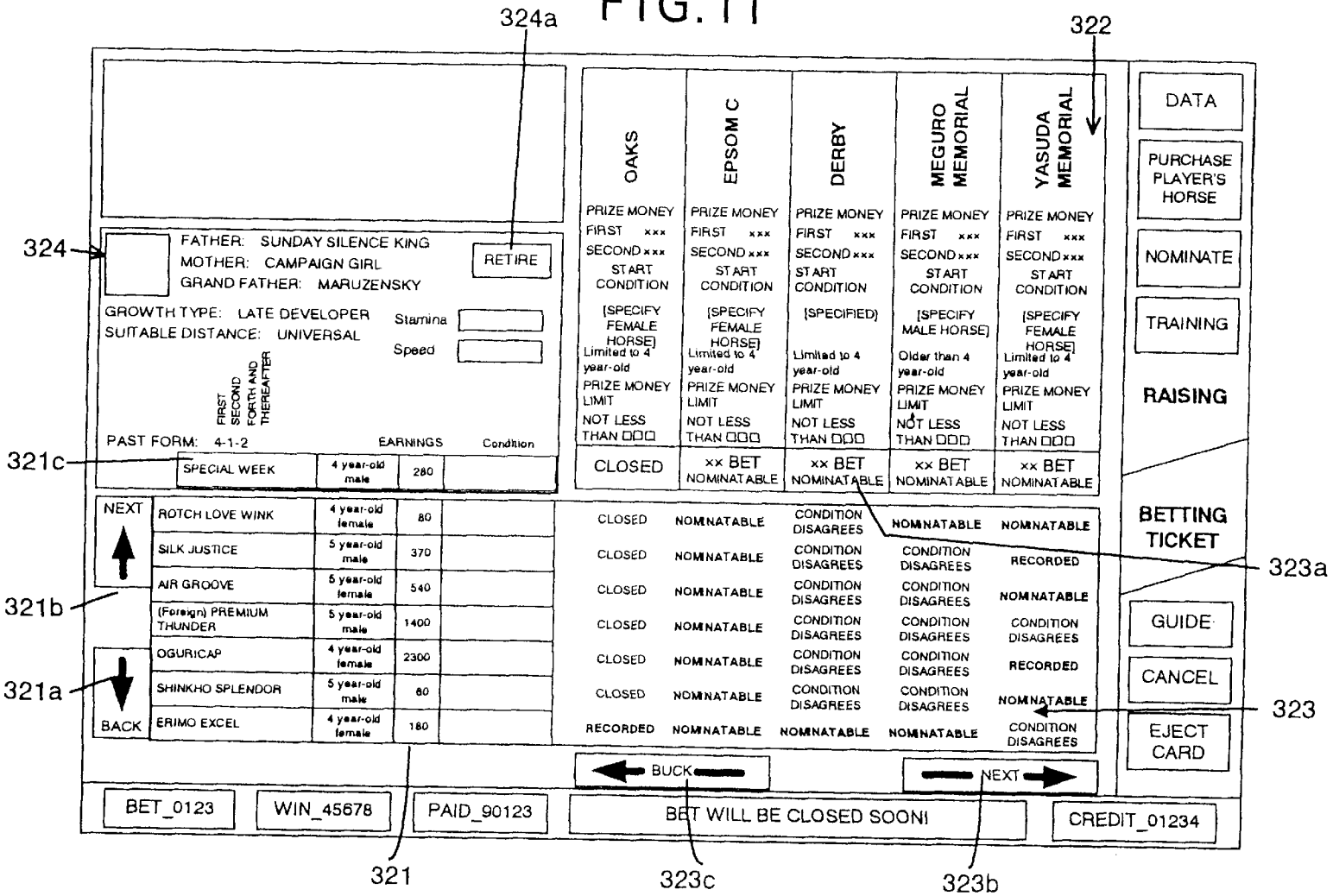
FIG. 11 is a diagram showing a race selection screen.
Figure 12:
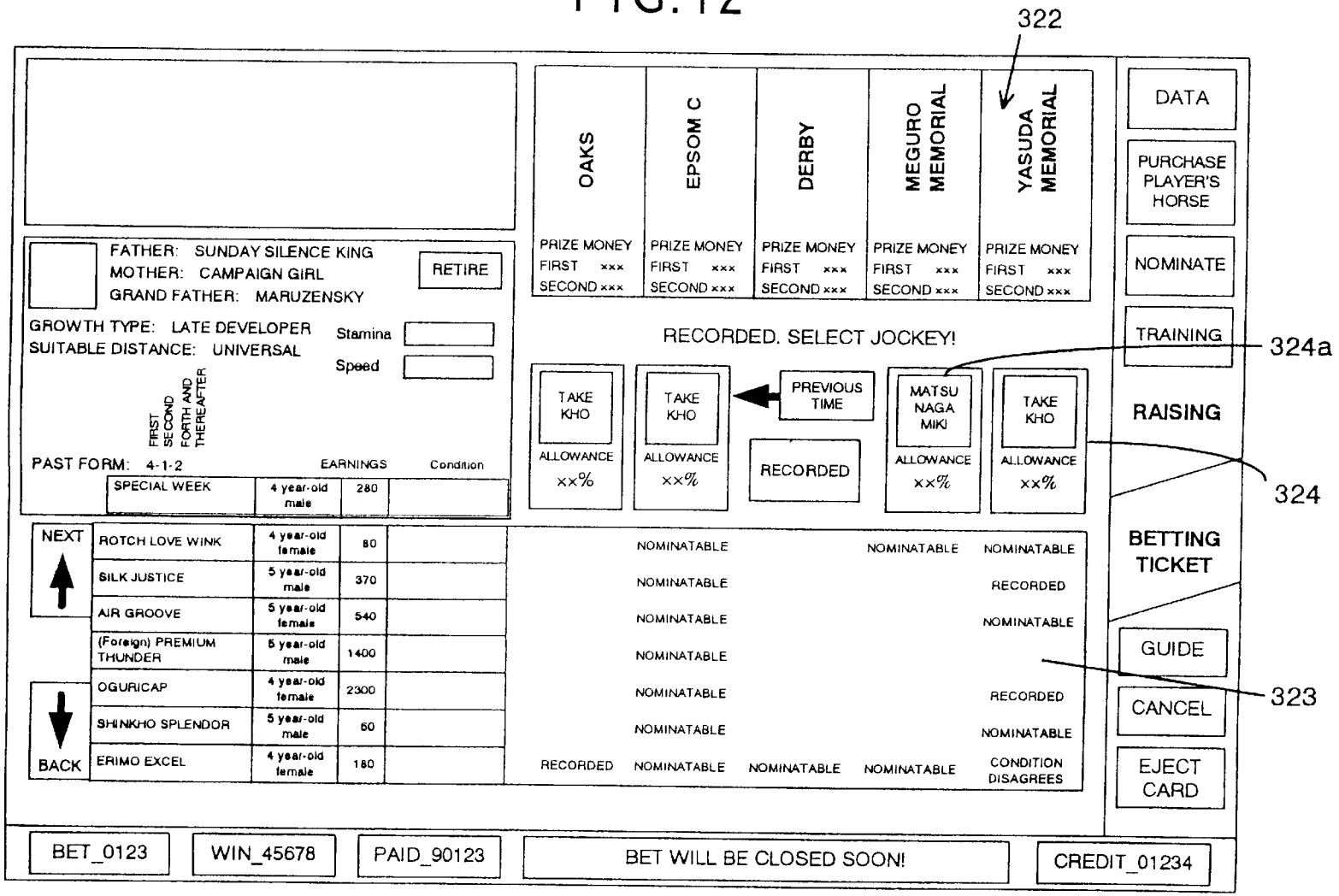
FIG. 12 is a diagram showing a leading jockey selection screen.

There will be described below the process at step S206 in FIG. 7 with reference to FIGS. 11 and 12. FIG. 11 is a diagram showing the race selection screen, and FIG. 12 is a diagram showing the jockey selection screen.

At step S206, a process for selecting a race for which the horse is nominated is executed. In this process, at first the race selection screen shown in FIG. 11 is displayed on the display 31 with reference to the player's data in the RAM 207. The left side of the race selection screen is provided with an area 321 where a list of the player's horses is displayed, and when the player operates buttons 321*a* and 321*b* of the area 321, the horse names can be scrolled up and down. The horse selected currently is displayed in an area 321*c* at the uppermost part.

The right side of the race selection screen is provided with an area 322 where race names are displayed, and an area 323 where each of the nominatable horses in each race displayed in the area 322 is displayed. As shown in FIG. 11, prize money and start condition in the case where a horse comes in first or second in each race are displayed together with the race names in the area 322. Four types of words: "Recorded" which represents that the nomination of corresponding horse has been already recorded; "Nominatable" which represents the corresponding horse is nominatable; "Condition disagrees" which represents that the corresponding horse disagrees with the start condition; and "Closed" which represents that the nomination recording is closed, are displayed in the area 323. As a result, the player can ascertain whether or not the horses are nominatable.

As for the horse displayed in the area 321*c*, namely, the selected horse, the above four types of words as well as buttons 323*a* where a number of bets to be paid by the player are displayed as the nomination recording condition in the races for which the horse is nominatable are provided. When the player operates the button 323*a*, the nomination of the selected horse is recorded for the race corresponding to the operated button 323*a*. For example in FIG. 11, when the player operates the button 323*a* corresponding to "Derby", the horse displayed in the area 321*c* is recorded as a horse to be nominated for "Derby". When the buttons 323*b* and 323*c* are operated, the race names arranged in the order of fixture can be scrolled in a right-and-left direction.

An upper part of the area 321*c* is provided with an area 324 where information about the horse selected currently is displayed, and when a retire button 324*a* in the area 324 is operated, the horse displayed in the area 321*c* can be retired.

Next, the jockey selection screen shown in FIG. 12 is displayed on the display 31. On this screen, a jockey who rides on the recorded horse is selected. Since the abilities vary from respective jockeys, the percentage of victories in the races changes according to the selected jockeys. Moreover, since mount tactics vary from the respective jockeys, it is necessary to judge congeniality between the jockeys and running type of the nominated horses. For this reason, skill which is equivalent to that of the actual horse racing is required, and reality of the games can be improved.

Salary of the jockeys according to their ability or the like, namely, jockey share in the case where the horse nominated for the race acquires prize money, is set. For example, in the case of a front-rank jockey, the percentage of victories is high, namely, the jockey's share is 60% and player's share is 40%. In the case of a third-rate jockey, the percentage of victories is low, namely, the player's share is 100%. In this case, as for the race where prize money is two-hundred medals, for example, when a first-rate jockey on the horse wins the race, the player can acquire eighty medals, and when a third-rate jockey on the horse wins the race, the player can acquire two-hundred medals.

Therefore, the player can select a jockey taking not only the odds of the medal game but also the odds of the race into consideration. Accordingly, in the present embodiment, diversified ways to enjoy the game can be provided to the player.

As shown in FIG. 12, the percentage of the jockey share and the mount method (front running, stretch running and the like) as well as the jockey's names are displayed in the area 324, and the player can select a jockey referring to the jockeys' share. When the player operates the buttons 324*a* arranged in the area 324, the jockey corresponding to the button 324*a* is set as a jockey who rides on the horse in the race.

The jockey who rides on the horse is stored by rewriting the player's data in the RAM 207.

After the above process is completed, the sequence returns to step S201.

Meanwhile, when the determination at step S204 is NO, the sequence goes to step S207 so that a determination is then made as to whether or not the player selects training of the player's horse. When the determination is YES, the sequence goes to step S208. At step S208, a determination is made as to whether or not the player has already owned horses referring to the player's data in the RAM 207, and when the determination is YES, the sequence goes to the training process at step S209. When the determination is NO, the sequence returns to step S201.

There will be described below the training method at step S209 with reference to FIG. 13.

In the training process, the player bets his/her medals so that the horse is trained, and as a number of medals bet is large, the ability of the horse after the training is improved more. For example, the player can bet one through three medals and the trained result according to the number of medals can be obtained. Since the player bets medals and trains the horse so that the ability of horse is improved and the percentage of victories in the race can be heightened, the player can raise the horse in a form that the medals are saved for the horse.

In such a manner, in the present embodiment, since the horse can be trained, the player can enjoy the reality that the player's horse is raised to be a strong race horse.

The ability of the horse is represented by a plurality of parameters (stamina, speed, condition). In the training process, the player cannot select which parameter nor how much a numerical value of the parameter is increased. Moreover, the player cannot select the training menu (contents of the training) either. Which parameter and how much the value of the parameter is increased is determined in the station control device 201 according to the selected stable and the number of bets. As a result, the horse can be trained without requiring a complicated input operation.

Figure 13:
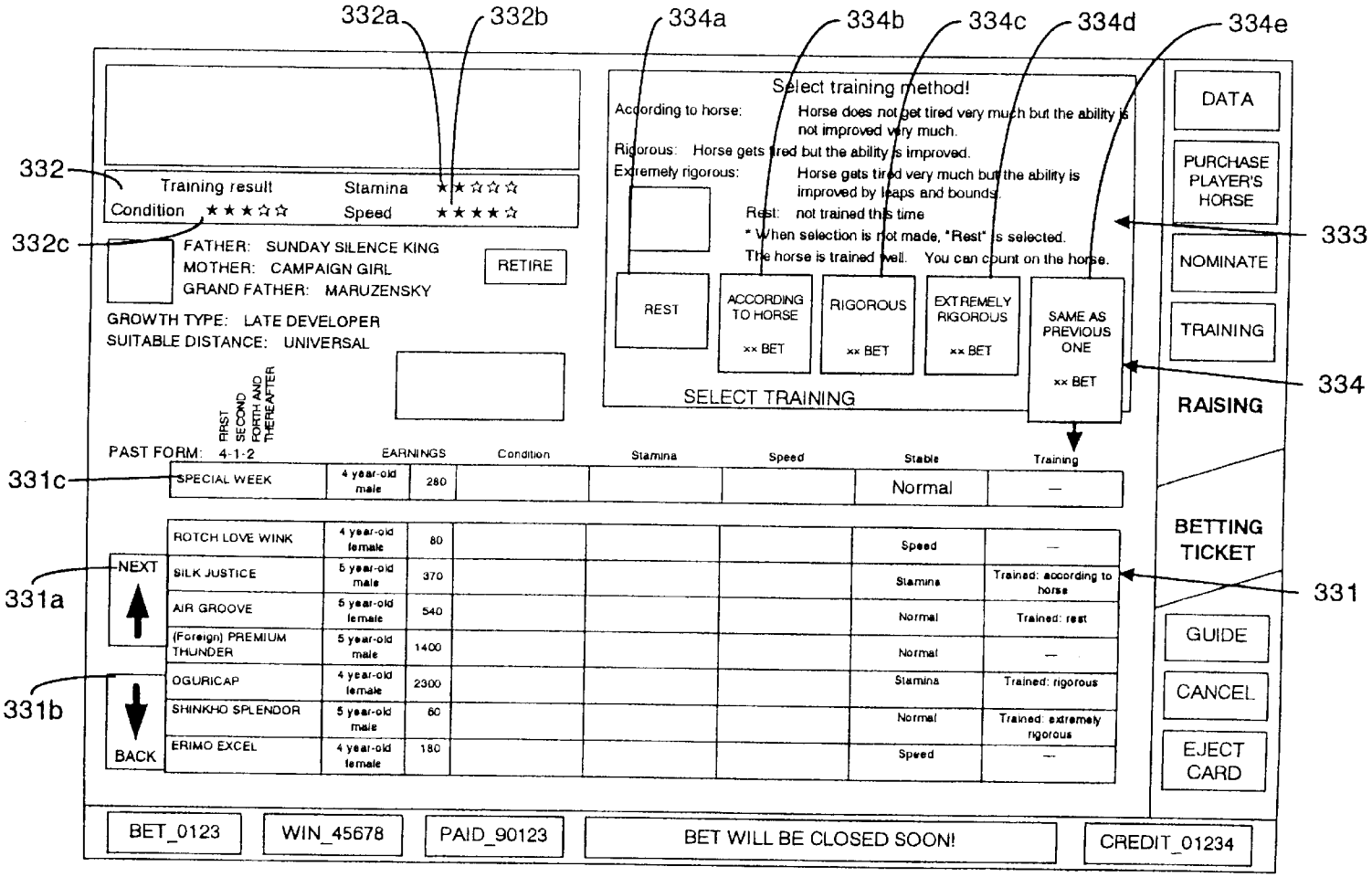
FIG. 13 is a diagram showing a training process screen.

As shown in FIG. 13, a table, which shows sex, age, earning, parameter, stable and previous training method of the player's horse, is displayed in an area 331 on a lower side of the training process screen. The display of the table can be scrolled by operating the button 331*a* and the button 331*b*. The horse which is currently selected as a horse to be trained is displayed on an uppermost part 331*c* of the area 331. The parameters of this horse are displayed as the trained results also in an area 332 on the upper left side of the training process screen. In the area 332, as the trained results, 332*a* represents the stamina, 332*b* represents the speed, and 332*c* represents the condition, and their grades are known by a number of highlighted starts, and they are added to the ability of the horse.

The upper right side of the training process screen is provided with an area 333 where the description of the training methods is displayed, and an area 334 where buttons for selecting the training methods are arranged. Buttons 334*a*, 334*b*, 334*c*, 334*d* and 334*e*, which shows the training methods such as "Rest", "According to horses", "Rigorous", "Extremely rigorous" and "Same as the last time", are arranged in the area 334, and the player operates the buttons 334*a*–334*e* so that the training method according to the operated button is selected.

When "Rest" is selected, the horse is not trained this time. When "According to horses" is selected, the horse is trained in such a manner that the horse does not get very tired but the ability is not improved very much. When "Extremely rigorous" is selected, the horse is trained in such a manner that the horse gets very tired but the ability is improved by leaps and bounds. When "Rigorous" is selected, the horse is trained to a type between the "According to horses" and "Extremely rigorous". Moreover, when "Same as the last time" is selected, the horse is trained in the manner same as the manner used for the horse last time. As a result, the effort of input operations can be avoided.

When the training process is completed, the sequence returns to step S201.

The training process at step S209 is executed only from the starting of the betting process to the starting of the next betting process as shown in FIG. 15. At the time when the next betting process is started, the training process is forcibly ended, and the sequence returns from the step S209 to step S201. Moreover, only one-time training is possible per this period, and the training cannot be repeated two or more times. Therefore, the player's horse cannot be raised rapidly thereby neglecting the passage of time assumed by the cycle of the races, and reality is given to the raising speed or development speed of the horse.

The trained results obtained by the selected training method and this training are stored by rewriting the player's data in the RAM 207.

Meanwhile, when the determination at step S207 is NO, the sequence goes to step S210. At step S210, a determination is made as to whether or not the completion of the raising process is selected by the player's operation, and when the determination is NO, the sequence goes to step S211.

At step S211, a determination is made as to whether or not the data display process is selected by the player's operation, and when the determination is YES, the sequence goes to the data display process at step S212. When the determination is NO, the sequence returns to step S201.

Figure 14:
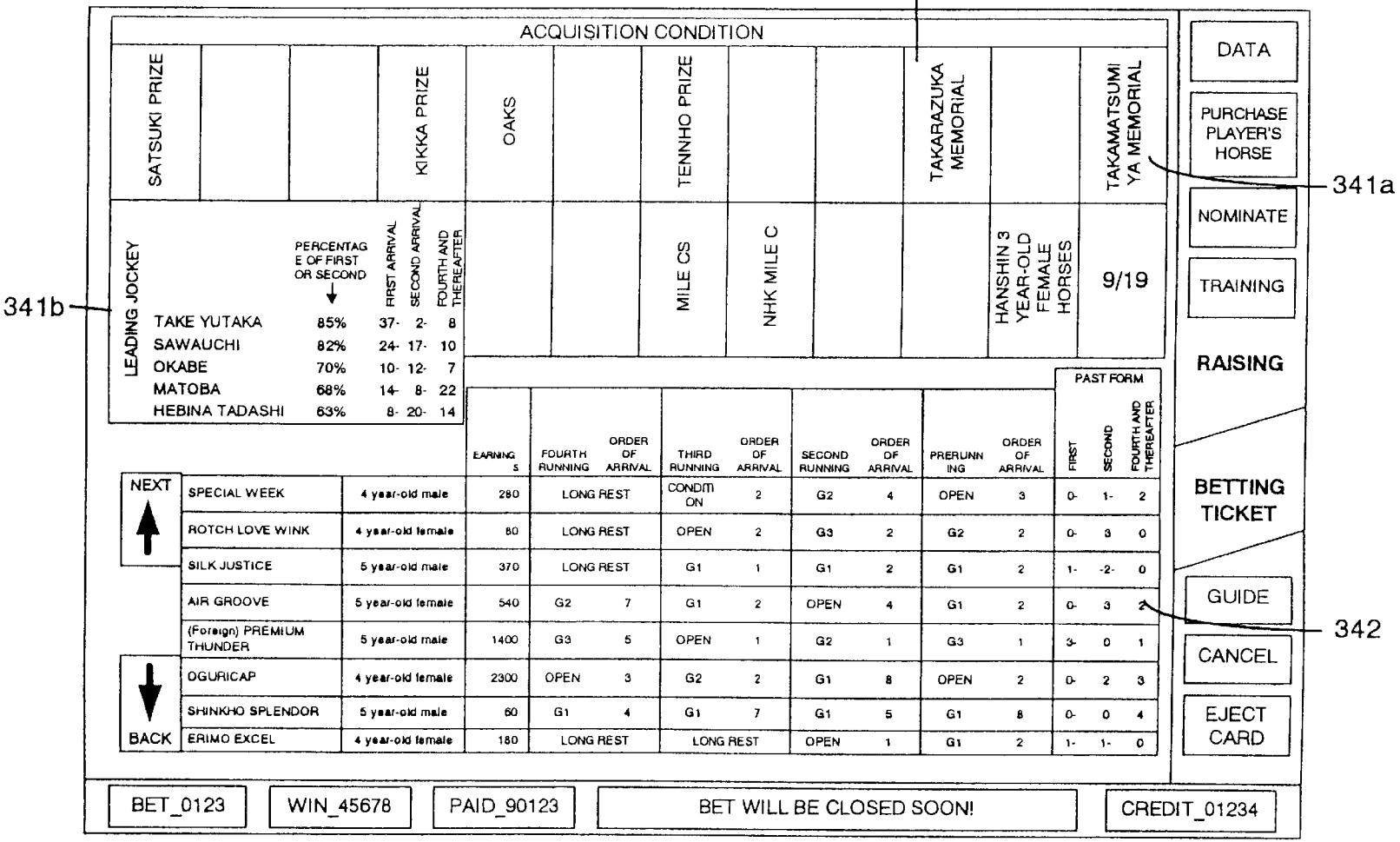
FIG. 14 is a diagram showing a data display screen.

There will be described below the data display process at step S212 with reference to FIG. 14. FIG. 14 shows the data display screen displayed on the display 31 in the data display process. An area 341 provided to the upper side of the data display screen is provided with display 341*a* of a table of G1 race victory or defeat, and display 341*b* of results of the leading jockeys. Moreover, an area 342 where a table of results of the horses is displayed is provided to the lower side of the data display screen. As shown in FIG. 14, the horses names, age, sex, earnings and past form are displayed in the area 342.

When the process at step S212 is completed, the sequence returns to step S201.

Meanwhile, when the determination at step S210 is YES, the sequence returns to step S111 (FIG. 6).

The above data display is carried out by referring to the player's data stored in the RAM 207.

There will be described below a player's data retaining method, the process in FIG. 16 and the data updating process (FIG. 7).

In this game machine 1, as destinations where the player's data (FIG. 4A) is retained, two storage devices, i.e., the SRAM 105 and the flash memory 106, are prepared. A unit price per capacity of the SRAM 105 is comparatively high, but the access speed is high and a life against rewriting is long. For this reason, in the present embodiment, player's data which might be rewritten frequently is stored in the SRAM 105. On the contrary, player's data where the last play date is comparatively old is retained in the flash memory 106 with large capacity where a unit price per capacity is low.

Since the destinations where the player's data are stored are divided as mentioned above, in the present embodiment, the SRAM 105 takes priority of being used as the destination where the player's data is retained, and when the capacity of the SRAM 105 becomes insufficient, the player's data where last updating date is older is transferred successively to the flash memory 106 so that free space is formed in the storage area of the SRAM 105. Moreover, the player's data retained in the flash memory 106 is deleted manually or deleted automatically after a predetermined period of time passes from the last updated date. As a result, free space is secured in the flash memory 106. It is desirable that the player is warned of the term of a guarantee that the player's data is not deleted and is retained as the term of validity of the game play. Balance of a period up to the deletion and capacities of the SRAM 105 and the flash memory 106 is set in a suitable range so that the player's data can be managed appropriately.

When the player comes back to the game machine 1 and the player's data which has been already transferred to the flash memory 106 is reused and updated, as described later in the process in FIG. 16, the player's data is transferred from the flash memory 106 to the SRAM 105. In the case where the player frequently plays games and the updating interval of the player's data is short, during the games, the player's data is still retained in the SRAM 105 without being transferred to the flash memory 106.

There will be described below the collating process with reference to FIG. 16. The collating process is started in response to the request of the station control device 201 at step S104 (FIG. 6), and this process is executed in the main control device 101.

Figure 16:
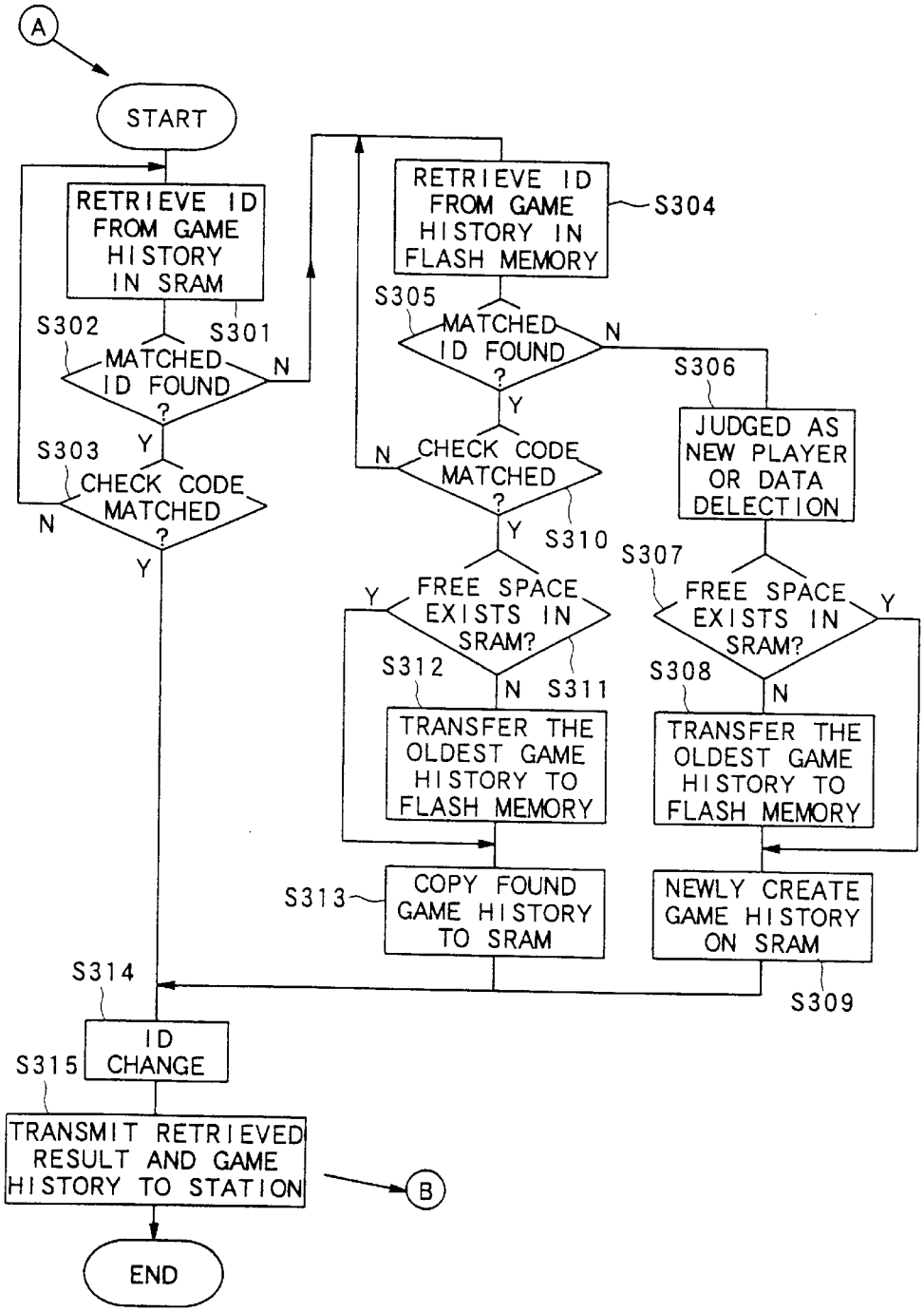
FIG. 16 is a flowchart showing a collating process.

At step S301 in FIG. 16, the player's data retained in the SRAM 105 is retrieved. At the next step S302, a determination is made as to whether or not the player's data, which include the ID code identical to the ID code which was requested to be retrieved at step S104, is found. When the determination is YES, the sequence goes to step S303 so that a determination is made as to whether or not the check code transmitted at step S104 matches the check code of the player's data found at the SRAM 105. When the determination is YES, the sequence goes to step S314, and when the determination is NO, the sequence returns to step S301.

When the determination at step S302 is NO, the sequence goes to step S304 so that the player's data retained in the flash memory 106 is retrieved. At the next step S305, a determination is made as to whether or not the player's data, which include the ID code identical to the ID code which was requested to be retrieved at step S104, is found. When the determination is YES, the sequence goes to step S310 so that a determination is then made as to whether or not the check code transmitted at step S304 matches the check code of the player's data found in the flash memory 106. When the determination is YES, the sequence goes to step S311, and when the determination is NO, the sequence returns to step S304. At step S311, a determination is made as to whether or not a free area exists in the SRAM 105. When the determination at step S311 is NO, the player's data which has not been updated for the longest time in the SRAM 105 is transferred to the flash memory 106 (step S312), and the sequence goes to step S313. When the determination at step S311 is YES, the sequence skips to step S313. At step S313, the state and history of the games (player's data) found in the flash memory 106 are copied to the SRAM 105, and the sequence goes to step S314.

Meanwhile, when the determination at step S305 is NO, at step S306 a determination is made that the player is a new player or the player's data in the flash memory 106 has been already deleted. At the next step S307, a determination is made as to whether or not free area exists in the SRAM 105. When the determination at step S307 is NO, the player's data which has not been updated for the longest time in the SRAM 105 is transferred to the flash memory 106 (step S308), and the sequence goes to step S309. When the determination at step S307 is YES, the sequence skips to step S309. At step S309, the state and history of the games (player's data) found in the flash memory 106 are copied to the SRAM 105, and the sequence goes to step S314.

At step S314, a new ID code is created, and at the next step S315, the new ID code, the retrieved results, and the found game history or newly created history are transmitted to the station control device 101, and the process in FIG. 16 is ended. The ID code which was transmitted in the process at step S315 is retained at step S106 (FIG. 6). Moreover, the determination at step S107 and the process at step S108 are carried out based on the transmitted contents at step S315.

There will be described below the data updating process with reference to FIG. 17. The data updating process is started in response to the data updating command (FIG. 5) at step S7, and it is carried out in the main control device 101.

Figure 17:
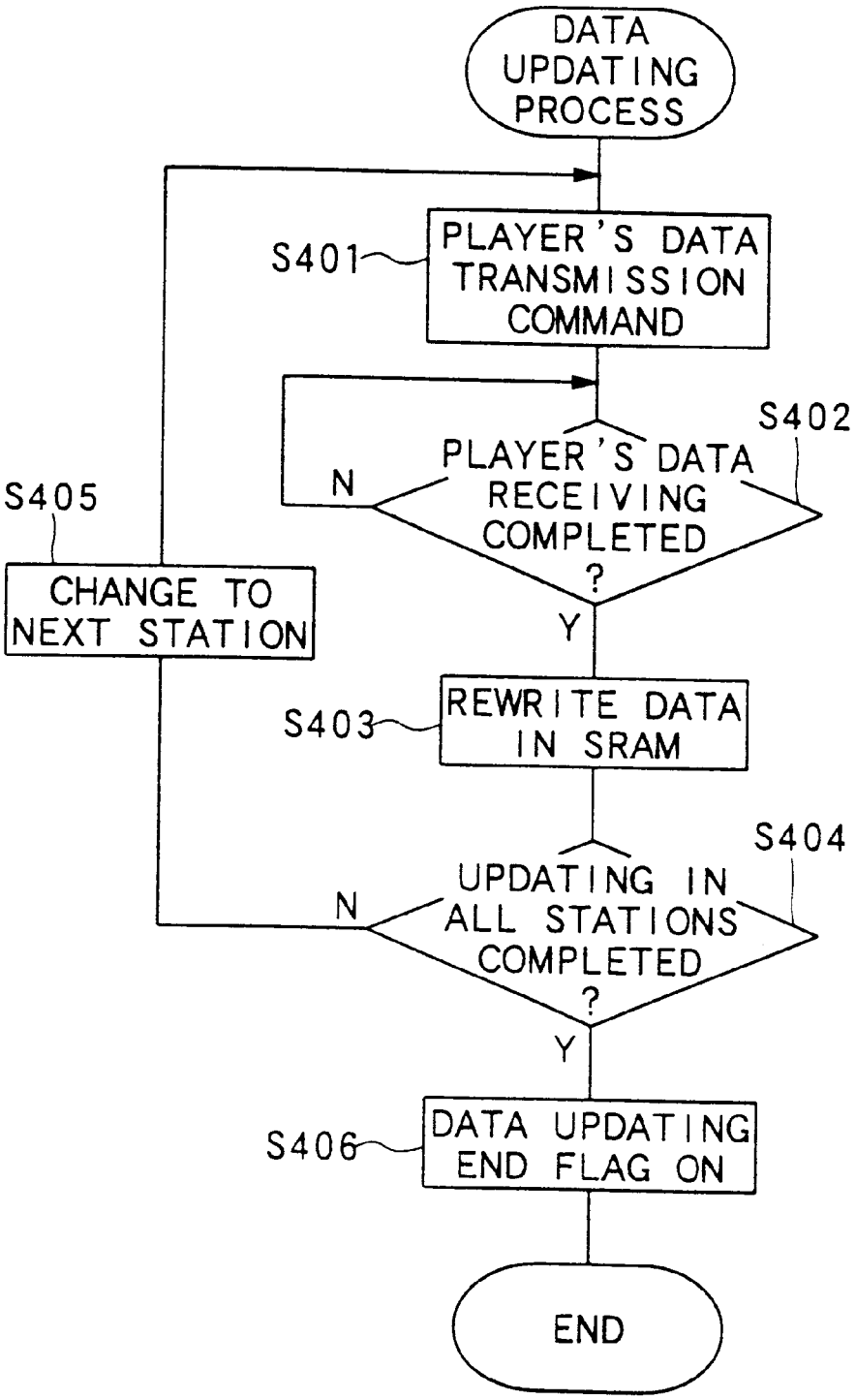
FIG. 17 is a flowchart showing a data process.

At step S401 of FIG. 17, a command for requesting the transmission of the player's data, namely, a player's data transmission command, is transmitted to the station control device 201 of the respective stations 3. Upon receiving the player's data transmission command, the process for transmitting the player's data to the main control device 101 is carried out in the station control devices 201 of the respective stations 3.

At the next step S402, the sequence waits for the reception of the player's data from all the stations 3 so as to go to the step S403. At step S403, the player's data retained in the SRAM 105 is rewritten into the player's data transmitted from the station control devices 201 of the stations 3, and the sequence goes to step S404.

At the next step S404, a determination is made as to whether or not the updating of the player's data is completed in all the stations 3 to which the player's data is transmitted to the main control device 101. When this determination is NO, the sequence goes to step S405, and an object of the player's data in the SRAM 105 to be rewritten is changed into next station 3, and the sequence returns to step S401. When this determination is YES, a data updating end flag is turned ON at step S406, and the process is ended. The data updating end flag is, as mentioned above, a flag to be determined at step S8 in the cycle process of FIG. 5, and when the data updating end flag is ON, the sequence goes from step S8 to step S9. Therefore, when the updating of the player's data is completed in all the stations 3, the sequence goes to the next race process.

As mentioned above, in the present embodiment, since the states and histories of the games up to the last time are retained as the player's data, when the player comes back to the game, the rest of the game which was suspended last time can be restarted. However, while the game machine 1 is operated, annual races are held successively in the game machine 1, and one year from a game viewpoint passes within two to three hours. Therefore, for example, in the case where the player ends the play at the race of "Yayoi Prize (March)" and the player comes back a few days after and restarts the play at the time of the "Derby (June)" race, a dozen years on the game has passed. At this time, if it is regarded that the time on the game has passed according to the operating time of the game machine 1 and the play is restarted, the player's horse has not been trained at all for a dozen years and the horse got old. For this reason, the player loses interest in the games.

For this reason, in the present embodiment, the passage of time on the games is managed independently per player, and in the above case, the play is restarted at the time of the "Yayoi prize" race where the player suspended the play and the "Derby" race in the same year, and it is regarded that the horse has rested for three months on the game. As a result, even when the game is suspended, when the player restarts the play, the player's horse can display the ability sufficiently, and the player can enjoy the schedule of the JRA sufficiently. Since it is not preferable that the passage of time on the game is reversed, for example, in the case where the play is suspended at the "Derby (June)" race and the play is restarted at the "Yayoi (March)" race, it is regarded that the restarted race is the "Yayoi (March)" race in the next year. Namely, the player's horse has rested for nine months.

Figure 18:
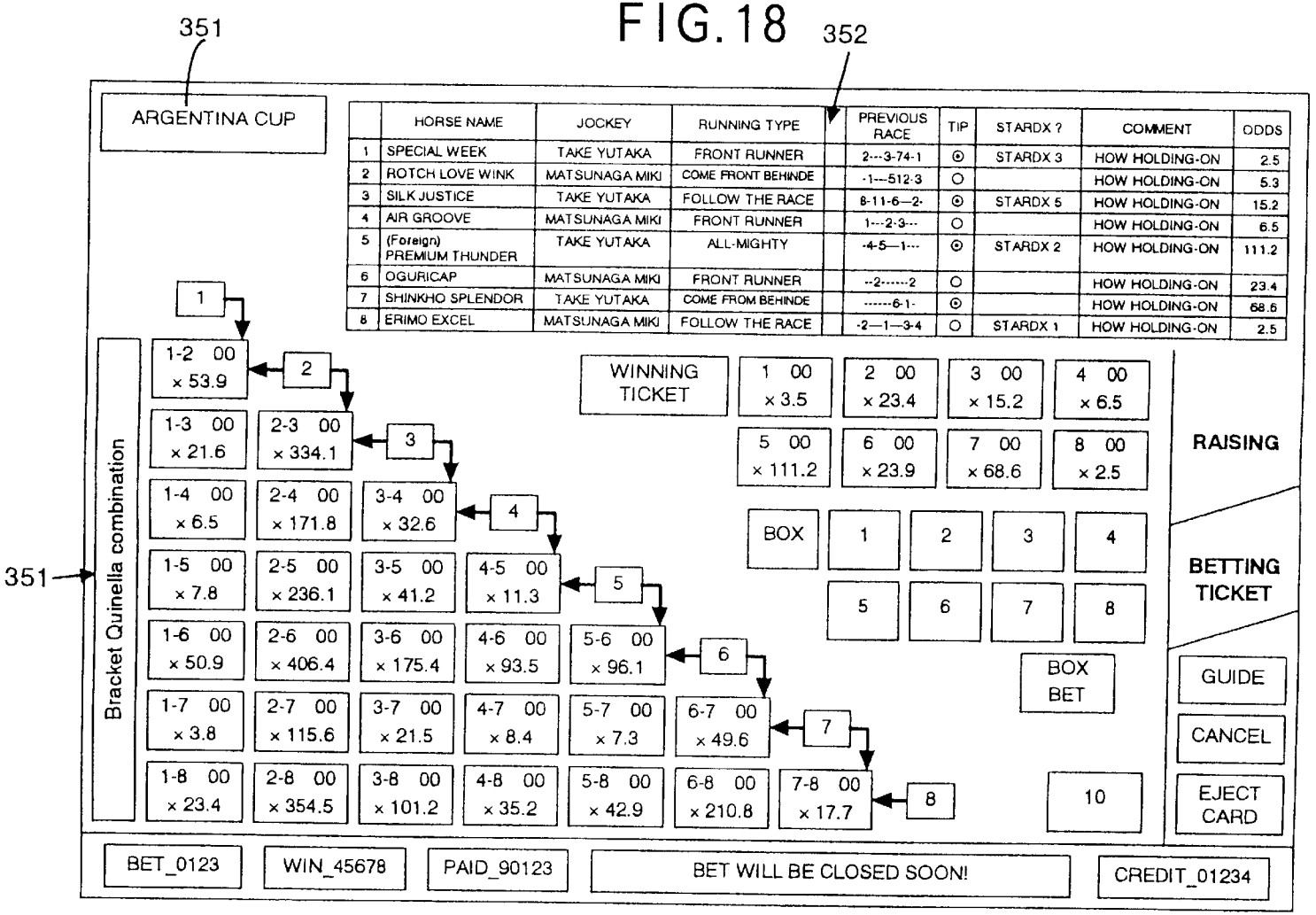
FIG. 18 is a diagram showing a bet screen.

FIG. 18 shows the betting screen displayed on the display 31 in the betting process. As mentioned above, in the betting process, the player can purchase betting tickets of the races (see FIGS. 5 and 15). As shown in FIG. 18, the upper left side of the betting screen is provided with an area 351 where race names are displayed, the upper right side of the betting screen is provided with an area 352 where information about the horses nominated for the race is displayed, and the lower side of the betting screen is provided with an area 353 where the odds of the race are displayed. In the betting process, the player operates a predetermined place of the area 252 so as to be capable of purchasing betting tickets.

The betting screen display method may be changed according to the results of the player's horses. For example, in the case where the player's horse wins the G1 race, the display image of the horse displayed in the area 352 can be different from those of the other horses, or the display layout of the horse can be different from those of the other horses.

In the present embodiment, since the states and histories of the play are not stored in the magnetic card but in the game machines 1, in the case where the respective game machines 1 are installed independently, the player cannot play the rest of the game unless the player uses the same game machine 1. Therefore, a plurality of game machines are connected via some communication means so that the player's data can be transmitted. When the player's data is transmitted, the player can play the rest of the game using another game machine.

In addition, the states and histories of the games may be stored in a portable recording medium such as a magnetic card or an IC built-in card. In this case, since the game can be continued by using the information stored in the portable recording medium, a game machine which is used for continuing the rest of the game is not limited. Therefore, the player can enjoy the rest of the games in another place where the game machine is installed.

In the present embodiment, every time the game is suspended, the ID code is changed (step S314), but it is not always necessary to change the ID code every time. Moreover, since improper use of the magnetic card can be prevented by the process for changing the check code, the ID code is not changed and a constant ID code may be set in one magnetic card. Moreover, only ID code may be used as the specifying information.

The present embodiment referred to the race horse raising game as an example of the raising, but for example, the present invention can be applied also to games where player can enjoy a process for tuning up a car in an auto race or a process for improving the ability of a cycle racer. In the specification, "Raising" includes a general idea that the ability of all objects in games is improved and the ability is controlled.

According to one aspect of the invention, since the states and histories of the game stored in storage means are used, the continuity of the game can be secured. Moreover, since the states and histories of the game are stored in the storage means, it is not necessary to record the states and history of the game in a recording medium. For this reason, improper use of the recording medium can be effectively prevented.

According to another aspect of the invention, since the states and histories of the game stored in a recording medium are used, the continuity of the game can be secured.

According to yet another of the invention, since the states and histories of the game stored in the storage means are used, the continuity of the game can be secured. Moreover, since the states and histories of the game stored in the storage means are obtained via communication means, the rest of the game played in a first game machine can be played in a second game machine.

According to still another aspect of the invention, since a determination is made by judging means as to the correctness or incorrectness of specifying information in the recording medium, improper use of the recording medium can be prevented.

What is claimed is:

1. A game system for paying for recreating value according to progress of a game, comprising:

a plurality of recording mediums, each of said recording mediums containing unique code information; and an arcade machine, said recording mediums being detachably connectable to said arcade machine, said arcade machine having reading means for reading the code information in each of said recording mediums when said recording mediums are coupled to said arcade machine;

storage means for storing a state and a history of suspended games each in association with the code information in a respective one of said recording mediums;

stations for accepting input operations by players;

game progress means for progressing a game in accordance with the input operations accepted by said stations; and paying means for paying for recreation value according to the progress of the game in said game progress means, wherein said game progress means restarts a suspended game using the state and history of the suspended game stored in said storage means when said reading means read the code information on a respective one of said recording mediums associated with the suspended game.

2. A game system according to claim 1, wherein said recording mediums do not contain the state and history of a suspended game.

3. A game system according to claim 1, wherein said recording mediums contain additional information not related to progress of the game.

4. A game system according to claim 1, wherein said recording mediums are magnetic cards.

5. A game system according to claim 1, wherein said arcade machine further comprises determining means for determining whether the code information read by said reading means is correct.

6. A game system according to claim 1, wherein the state and history of the game include final play information regarding the last time the game was played; and wherein the older states and histories of games stored in said storage means take priority in a deletion process based on the final play information.

7. A game system according to claim 1, wherein said reading means is provided to each of said stations.

8. A game system according to claim 1, wherein said storage means includes:

a first storage device provided to each of said stations, for temporarily storing the state and history of the game generated according to the input operations; and a second storage device for updating the old state and history of the game by means of the state and history of the game stored in said first storage device.

9. A game system according to claim 8, wherein said game progress means reads the corresponding state and history of the game from said second storage device into said first storage device based on the code information read by said reading means, and continuously progresses the game using the state and history of the game read into said first storage device.

10. A game system according to claim 1, wherein said arcade machine further comprises a common field for progressing the game; said stations being arranged to accept input operations by a player relating to the game progressed in said common field.

11. A game system according to claim 6, wherein the object to be raised is a race horse on the game, and the object is nominated for the race in said common field.

12. A game system according to claim 10, wherein:

the state and history of the game include raised results of an object to be raised by the player in the station; and the object to be raised participates in a race on the game in said common field, and the object displays its ability in the race according to the raised results.

13. A game system according to claim 1, wherein the state and history of the game include raising results of an object to be raised by the player on the game.

14. A game system according to claim 13, wherein:

the state and history of the game include the raising results of an object to be raised by the player on the game; and the object to be raised participates in a race on the game, and the object displays its ability in the race according to the raised results.

15. A game system according to claim 13, wherein said recording mediums are magnetic cards.

16. A game system according to claim 13, wherein said arcade machine further comprises determining means for determining whether the code information read by said reading means is correct.

17. A game system according to claim 1, wherein said arcade machine further comprises writing means for writing information into said recording mediums, wherein said writing means writes the code information into each of said recording mediums at the time of suspension of the game.

18. A game system according to claim 17, wherein said arcade machine further comprises a common field for progressing the game; said stations being arranged to accept input operations by a player relating to the game progressed in said common field.

19. A game system according to claim 17, wherein the state and history of the game include final play information regarding the last time the game was played; and wherein the older states and histories of games stored in said storage means take priority in a deletion process based on the final play information.

20. A game system according to claim 17, wherein said recording mediums are magnetic cards.

21. A game system according to claim 17, wherein the state and history of the game include raising results of an object to be raised by the player on the game.

22. A game system according to claim 21, wherein said arcade machine further comprises determining means for determining whether the code information read by said reading means is correct.

23. A game system according to claim 21, wherein said recording mediums are magnetic cards.

24. A game system according to claim 17, wherein said writing means rewrites the code information in the recording mediums at the time of suspension of the game.

25. A game system according to claim 24, wherein said arcade machine further comprises:

collating means for collating the code information stored in said recording mediums and in said storage means; and code information creating means for creating the code information based on internal information in said game system, wherein said writing means writes the code information created by said code information creating means into said recording mediums; and the code information created by said code information creating means is stored in said storage means.

26. A game system according to claim 24, wherein said arcade machine further comprises a common field for progressing the game; said stations being arranged to accept input operations by a player relating to the game progressed in said common field.

27. A game system according to claim 24, wherein the state and history of the game include final play information regarding the last time the game was played; and wherein the older states and histories of games stored in said storage means take priority in a deletion process based on the final play information.

28. A game system according to claim 24, wherein the state and history of the game include raising results of an object to be raised by the player on the game.

29. A game system according to claim 24, wherein said arcade machine further comprises determining means for determining whether the code information read by said reading means is correct.

30. A game system according to claim 24, wherein said recording mediums are magnetic cards.

31. A game system according to claim 17, wherein said arcade machine further comprises determining means for determining whether the code information read by said reading means is correct.

32. A game system for paying for recreation value according to progress of a game, comprising:

a first arcade game machine;

a second arcade game machine;

a plurality of recording mediums, each of said recording mediums containing unique code information and being detachably connectable to said first and second arcade game machines;

storage means arranged in said first arcade game machine for storing a state and history of suspended games each in association with the code information in a respective one of said recording mediums; and communication means for connecting said second arcade game machine and said storage means, wherein said first and second arcade game machines are each provided with:

reading means for reading the code information in each of said recording mediums when said recording mediums are coupled to said arcade machine;

stations for accepting input operations by players;

game progress means for progressing a game in accordance with the input operations accepted by said stations; and pay means for paying recreation value according to progress of the game in said game progress means, wherein said game progress means of said second arcade game machine acquires the state and history of the suspended game stored in said storage means via said communication means when said reading means of said second arcade game machine read the code information on a respective one of said recording mediums associated with the suspended game, and restarts the suspended game in said second arcade game machine using the acquired state and history of the suspended game.

33. A game system according to claim 32, wherein said recording mediums do not contain the state and history of a suspended game.

* * * * *